US007553141B2

(12) United States Patent
Masuda

(10) Patent No.: US 7,553,141 B2
(45) Date of Patent: Jun. 30, 2009

(54) ROTARY FLUID MACHINE WITH A SUCTION SHUTOFF ANGLE OF THE OUTER CYLINDER CHAMBER BEING GREATER THAN A SUCTION SHUTOFF ANGLE OF THE INNER CYLINDER CHAMBER

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 12/128,457

(22) Filed: May 28, 2008

(65) Prior Publication Data

US 2008/0232991 A1 Sep. 25, 2008

Related U.S. Application Data

(62) Division of application No. 11/587,141, filed on Oct. 20, 2006, now Pat. No. 7,435,065.

(30) Foreign Application Priority Data

Apr. 23, 2004 (JP) ..... 2004-127904
May 24, 2004 (JP) ..... 2004-152688

(51) Int. Cl.
*F03C 2/00* (2006.01)
*F04C 18/00* (2006.01)
*F04C 2/00* (2006.01)

(52) U.S. Cl. ..... 418/59

(58) Field of Classification Search ..... 418/57–59, 418/62, 63, 104
See application file for complete search history.

(56) References Cited

U.S. PATENT DOCUMENTS

| | | | | |
|---|---|---|---|---|
| 141,226 | A | 7/1873 | Jenkins et al. | |
| 1,229,676 | A * | 6/1917 | Tice | 418/59 |
| 1,658,803 | A | 2/1928 | Heinrich | |
| RE24,500 | E | 7/1958 | Heinrich | |
| 3,999,904 | A | 12/1976 | Raymond | |
| 4,606,711 | A | 8/1986 | Mitsui et al. | |
| 5,011,386 | A | 4/1991 | Guttinger | |
| 2005/0031465 | A1 | 2/2005 | Dreiman et al. | |

FOREIGN PATENT DOCUMENTS

| | | |
|---|---|---|
| JP | 51-23371 | 6/1976 |
| JP | 57-8385 | 1/1982 |
| JP | 59-113289 | 6/1984 |

(Continued)

*Primary Examiner*—Theresa Trieu
(74) *Attorney, Agent, or Firm*—Global IP Counselors

(57) ABSTRACT

A rotary fluid machine includes an eccentric rotary piston mechanism that is configured such that an annular piston is accommodated in an annular cylinder chamber of a cylinder to form an outer cylinder chamber and an inner cylinder chamber. The cylinder and the annular piston relatively execute eccentric rotary motion. Each of the outer and inner cylinder chambers is divided by a blade into a first chamber and a second chamber. The blade and the annular piston are mutually movably coupled together by a swinging bushing. The blade is provided, in its contact parts with the annular piston and the swinging bushing, with sliding surfaces in order to prevent the occurrence of seizure and wear of the blade and the annular piston and the occurrence of gas leakage between the first chamber and the second chamber during operation.

2 Claims, 14 Drawing Sheets

FOREIGN PATENT DOCUMENTS

| | | | |
|---|---|---|---|
| JP | 60-90581 | | 6/1985 |
| JP | 60-90584 | | 6/1985 |
| JP | 60-92789 | | 6/1985 |
| JP | 63-60094 | | 4/1988 |
| JP | 04-12185 | | 1/1992 |
| JP | 06-159278 | | 6/1994 |
| JP | 06-288358 | | 10/1994 |
| JP | 06-323272 | | 11/1994 |
| JP | 08-247063 | | 9/1996 |
| JP | 09-158849 | | 6/1997 |
| JP | 11-182462 | | 7/1999 |
| JP | 11-190285 | | 7/1999 |
| JP | 2000-104677 | | 4/2000 |
| JP | 2000-161276 | A | 6/2000 |
| JP | 2001-248577 | | 9/2001 |
| JP | 2002-543333 | A | 12/2002 |
| WO | WO 02/088529 | A1 | 11/2002 |
| WO | WO 03078842 | A1 * | 9/2003 |

* cited by examiner

ROTARY FLUID MACHINE WITH A SUCTION SHUTOFF ANGLE OF THE OUTER CYLINDER CHAMBER BEING GREATER THAN A SUCTION SHUTOFF ANGLE OF THE INNER CYLINDER CHAMBER

CROSS-REFERENCE TO RELATED APPLICATIONS

This application is a divisional application of U.S. patent application Ser. No. 11/587,141 filed on Oct. 20, 2006. The entire disclosure of U.S. patent application Ser. No. 11/587,141 is hereby incorporated herein by reference. U.S. National stage application Ser. No. 11/587,141 and this application claim priority under 35 U.S.C. §119(a) to Japanese Patent Application Nos. 2004-127904, filed in Japan on Apr. 23, 2004, and 2004-152688, filed in Japan on May 24, 2004, the entire contents of which are hereby incorporated herein by reference.

TECHNICAL FIELD

The present invention generally relates to rotary fluid machinery, and more particularly to a rotary fluid machine having an eccentric rotary piston mechanism which is configured such that an annular piston is disposed in an annular cylinder chamber of a cylinder, the annular piston dividing the cylinder chamber into an outer cylinder chamber and an inner cylinder chamber and that the cylinder and the annular piston relatively execute eccentric rotary motion.

BACKGROUND ART

As a conventionally known rotary fluid machine of the type which is provided with an eccentric rotary piston mechanism including an annular piston which is configured to execute an eccentric rotary motion within an annular cylinder chamber, there is a compressor adapted to compress refrigerant by a volume change in the cylinder chamber associated with the eccentric rotary motion of the annular piston. See, for example, Japanese Patent Publication No. JP H6-288358A. As illustrated in FIG. 16 and FIG. 17 which is a cross sectional view taken along line XVII-XVII of FIG. 16 (hatching omitted), the compressor (100) has a hermetic casing (110) in which to house a compression mechanism (eccentric rotary piston mechanism) (120) and an electric motor (not shown) for driving the compression mechanism (120).

The compression mechanism (120) includes a cylinder (121) having an annular cylinder chamber (C1, C2), and an annular piston (122) disposed in the annular cylinder chamber (C1, C2). The cylinder (121) is made up of an outer cylinder (124) and an inner cylinder (125) which are arranged concentrically with each other and the cylinder chamber (C1, C2) is formed between the outer cylinder (124) and the inner cylinder (125).

The cylinder (121) is firmly fixed to the casing (110). In addition, the annular piston (122) is coupled, through a circular piton base (160), to an eccentric part (133*a*) of a driving shaft (133) coupled to the electric motor. The annular piston (122) is configured such that it executes an eccentric rotary motion with respect to the center of the driving shaft (133).

The annular piston (122) is so configured as to execute an eccentric rotary motion during which the annular piston (122) substantially comes into contact, at a point of the outer peripheral surface thereof, with the inner peripheral surface of the outer cylinder (124) (here, by such "substantial contact" is meant a state in which, although there is technically created a microscopic gap to such an extent that an oil film is formed, refrigerant leakage in the gap is negligible), while at the same time maintaining a state in which a point of the inner peripheral surface thereof substantially comes into contact, at a position 180 degrees out of phase with that outer peripheral surface point, with the outer peripheral surface of the inner cylinder (125). This results in forming an outer cylinder chamber (C1) and an inner cylinder chamber (C2), respectively, outside the annular piston (122) and inside the annular piston (122).

An outer blade (123A) is disposed outside the annular piston (122). An inner blade (123B) is disposed inside the annular piston (122), the inner blade (123B) lying on an extension of the outer blade (123A). The outer blade (123A) is biased radially inwardly of the annular piston (122) and its inner peripheral end is brought into pressure contact with the outer peripheral surface of the annular piston (122). On the other hand, the inner blade (123B) is biased radially outwardly of the annular piston (122) and its outer peripheral end is brought into pressure contact with the inner peripheral surface of the annular piston (122).

The outer blade (123A) divides the outer cylinder chamber (C1) into two partitions. The inner blade (123B) divides the inner cylinder chamber (C2) into two partitions. More specifically, the outer cylinder chamber (C1) is divided by the outer blade (123A) into a high pressure chamber (first chamber) (C1-Hp) and a low pressure chamber (second chamber) (C1-Lp) and the inner cylinder chamber (C2) is divided by the inner blade (123B) into a high pressure chamber (first chamber) (C2-Hp) and a low pressure chamber (second chamber) (C2-Lp). The outer cylinder (124) is provided, in the vicinity of the outer blade (123A), with a suction opening (141) which fluidly communicates with the outer cylinder chamber (C1) from a suction pipe (114) in the casing (110). In addition, the annular piston (122) is provided, in the vicinity of the suction opening (141), with a through-hole (143) by which the low pressure chamber (C1-Lp) of the outer cylinder chamber (C1) and the low pressure chamber (C2-Lp) of the inner cylinder chamber (C2) are brought into fluid communication with each other. Furthermore, the compression mechanism (120) is provided with a discharge opening (not shown) by which both the high pressure chamber (C1-Hp) of the outer cylinder chamber (C1) and the high pressure chamber (C2-Hp) of the inner cylinder chamber (C2) are brought into fluid communication with a high pressure space (S) in the casing (110).

In addition, in this example, an Oldham mechanism (161) as a rotation preventing mechanism is provided which allows the annular piston (122) to execute only eccentric rotary motion (revolution) while on the other hand preventing the annular piston (122) from rotating.

In the compression mechanism (120), when the annular piston (122) executes an eccentric rotary motion as the driving shaft (133) rotates, the volume of each of the outer and inner cylinder chambers (C1, C2) is alternately repeatedly reduced and expanded. When the volume of the cylinder chamber (C1, C2) increases, a suction process in which refrigerant is drawn into the cylinder chamber (C1, C2) from the suction opening (141) is carried out. On the other hand, when the volume of the cylinder chamber (C1, C2) decreases, a compression process in which refrigerant is compressed in the cylinder chamber (C1, C2) and a discharge process in which refrigerant is discharged from the cylinder chamber (C1, C2) into the high pressure space (S) of the casing (110) through the discharge opening are carried out. This high pressure refrigerant discharged into the high pressure space (S) of the casing (110) flows out to a condenser disposed along the refrigerant circuit by way of a discharge pipe (115) provided in the casing (110).

On the other hand, the aforesaid Japanese Patent Publication No. JP H6-288358A discloses another example which is a partial modification of the configuration of FIG. 17, as shown in FIG. 18. In the compression mechanism (120) of this example, the annular piston (122) is so split at a portion thereof as to be formed into a C-shape and the single blade (123) is passed transversely across the split and comes into contact with both the inner peripheral surface of the outer cylinder (124) and the outer peripheral surface of the inner cylinder (125). The inner peripheral surface of the outer cylinder (124) is formed such that its contact portion with the blade (123) has the same curvature radius as that of the outer peripheral surface of the inner cylinder (125). In addition, an Oldham mechanism (not shown) is provided to permit eccentric rotary motion (revolution) of the annular piston (122) about the inner cylinder (125) but prevent rotation of the annular piston (122). Like the example as shown in FIGS. 16 and 17, processes, such refrigerant suction, refrigerant compression, and refrigerant discharge, are accomplished by the eccentric rotary motion of the annular piston (122).

SUMMARY OF THE INVENTION

Problems that the Invention Intends to Solve

However, in the configuration as shown in FIGS. 16 and 17, the blades (123A, 123B) are in line contact with the annular piston (122). On the other hand, in the configuration as shown in FIG. 18, the blade (123) is in line contact with the cylinders (124, 125). Accordingly, when the annular piston (122) executes an eccentric rotary motion during the operation, the load which is applied to the contact portions is high. This may lead to wear and seizure of the contact portions.

Besides, since the members are in line contact with each other as described above, this produces a drawback in that the sealability of the contact portions is low. Consequently, the aforesaid configurations each include the possibility that refrigerant may leak from the high pressure chamber (C1-Hp, C2-Hp) to the low pressure chamber (C1-Lp, C2-Lp) in each of the outer and inner cylinders (C1, C2). Therefore, there is also the possibility that the compression efficiency will decrease.

In addition, in the above examples, the description has been made with respect to a compressor as a fluid machine. However, there is the possibility of wear of the contact portions between the blade (123A, 123B) (123) and the annular piston (122), and of gas leakage between the first chamber (C1-Hp, C2-Hp) and the second chamber (C1-Lp, C2-Lp), even when the fluid machine is an expander or a pump.

The present invention was devised with a view to overcoming the above-mentioned problems. Accordingly, an object of the present invention is to prevent, in a rotary fluid machine including an eccentric rotary piston mechanism which is configured such that (i) an annular piston is disposed in an annular cylinder chamber of a cylinder, the annular piston dividing the interior of the annular cylinder chamber into an outer cylinder chamber and an inner cylinder chamber, (ii) the cylinder and the annular piston relatively execute eccentric rotary motion, and (iii) each of the outer and inner cylinder chambers is divided by a blade into a first chamber and a second chamber, the occurrence of seizure and wear of the blade and the annular piston and the occurrence of gas leakage between the first chamber and the second chamber during the operation.

Means for Solving the Problems

The present invention provides a blade (23) and an annular piston (22) which are mutually movably coupled together by a coupling member (swinging bush) (27), thereby realizing a configuration capable of establishing member-to-member surface contact in coupling areas.

More specifically, the present invention provides, as a first aspect, a rotary fluid machine which comprises: (a) an eccentric rotary piston mechanism (20) which includes: a cylinder (21) having an annular cylinder chamber (C1, C2); an annular piston (22) housed, in an eccentric fashion relative to the cylinder (21), in the cylinder chamber (C1, C2) and dividing the cylinder chamber (C1, C2) into an outer cylinder chamber (C1) and an inner cylinder chamber (C2); and a blade (23) disposed in the cylinder chamber (C1, C2) and dividing each of the outer and inner cylinder chambers (C1, C2) into a first chamber (C1-Hp, C2-Hp) and a second chamber (C1-Lp, C2-Lp), the cylinder (21) and the annular piston (22) relatively executing eccentric rotary motion; (b) a driving mechanism (30) for driving the eccentric rotary piston mechanism (20); and (c) a casing (10) in which to house the eccentric rotary piston mechanism (20).

The rotary fluid machine of the first aspect is characterized in that:

- the cylinder (21) is provided with the blade (23);
- a coupling member (27) by which the annular piston (22) and the blade (23) are mutually movably coupled together is provided; and
- the coupling member (27) has a first sliding surface (P1) against the annular piston (22) and a second sliding surface (P2) against the blade (23). In addition, the term "annular" shape mentioned in the above configuration includes those such as perfect circle shape, ellipse shape, and ovoid shape.

In the first aspect of the present invention, when the eccentric rotary piston mechanism (20) which is implemented by a compression mechanism is activated, the cylinder (21) and the annular piston (22) relatively execute eccentric rotary motion. During the eccentric rotary motion, the annular piston (22) and the blade (23) relatively swing about a predetermined swing center and relatively travel back and forth in the surface direction of the blade (23). When the volume of the cylinder chamber (C1, C2) increases, gas is drawn into the cylinder chamber (C1, C2), and when the volume of the cylinder chamber (C1, C2) decreases, the gas is compressed.

In the first aspect of the present invention, when the blade (23) and the annular piston (22) operate (relative swing motion and advance/withdraw motion) via the coupling member (27), the coupling member (27) substantially comes into surface contact, in the sliding surfaces (P1, P2), with both the annular piston (22) and the blade (23). In addition, since the members are brought into surface contact with each other in the sliding surfaces (P1, P2) as described above, this makes it possible to reduce the load per unit of area which is applied to the surface contact portions.

In addition, in the first aspect of the present invention:

- the annular piston (22) is formed into a C-shape, i.e., a split-ring shape having at a portion thereof a split;
- the blade (23) is configured to be inserted through the split of the annular piston (22) so that the blade (23) extends from the inner peripheral wall surface to the outer peripheral wall surface of the annular cylinder chamber (C1, C2); and
- the coupling member (27) is formed by a swinging bush (27) having a blade groove (28) which advanceably and withdrawably holds the blade (23) and a circular arc-shaped outer peripheral surface which is swingably held in the split by the annular piston (22).

Accordingly, when the eccentric rotary piston mechanism (20) is activated, the blade (23) moves back and forth in the blade groove (28) of the swinging bush (27) while being in surface contact therewith and the swinging bush (27) swings in the split of the annular piston (22) while being in surface contact therewith. This ensures that the coupling member (27) comes into surface-to-surface contact with the annular piston (22) and the blade (23) and the load per unit of area which is applied to the contact portions is reduced without fail.

In addition, in the first aspect of the present invention, the swing center of the swinging bush (27) is displaced more radially inwardly than the wall thickness center of the annular piston (22).

Here, if the swinging bush (27) of the symmetrical type is employed whose center corresponds to the wall thickness center of the annular piston (22) and which has at its both sides identical chamfered parts (27*a*), as shown in FIG. 6(A) which depicts the annular piston (22) in its lower dead point position and as shown in FIG. 6(B) which depicts the annular piston (22) in its upper dead point position, this creates an invalid volume (Ds) inside the annular piston (22). This invalid volume (Ds) is a volume from which high pressure gas is not discharged, in other words, high pressure gas remains in the invalid volume (Ds) even after completion of a compression process in the high pressure chamber (C2-Hp) as a first chamber. As a result, the high pressure gas lingering in the invalid volume (Ds) leaks into the low pressure chamber (C2-Lp) as a second chamber at the start of a subsequent suction process and is re-expanded, thereby deteriorating the efficiency. Conversely speaking, if it is attempted to reduce reexpansion loss when the center of the swinging bush (27) is made to agree with the wall thickness center of the annular piston (22), this requires the provision of the swinging bush (27) of the asymmetric type which makes assembly work troublesome.

On the other hand, in the first aspect of the present invention, the center of the swinging bush (27) is displaced more radially inwardly than the wall thickness center of the annular piston (22), as shown in FIG. 7(A) which depicts the annular piston (22) in its lower dead point position and as shown in FIG. 7(B) which depicts the annular piston (22) in its upper dead point position. This therefore makes it possible to easily reduce reexpansion loss without creating the invalid volume (Ds) even when the swinging bush (27) of the symmetrical type is employed.

The present invention provides, as a fifth aspect according to the first aspect, a rotary fluid machine which is characterized in that:

the annular piston (22) is firmly fixed to the casing (10); and the cylinder (21) is coupled to the driving mechanism (30).

In the fifth aspect of the present invention, the cylinder (21) having the cylinder chamber (C1, C2) becomes a movable side and the annular piston (22) in the cylinder chamber (C1, C2) becomes a stationary side. Because of this, the blade (23) integral with the cylinder (21) advances and withdraws with respect to the annular piston (22) whose position is fixed while executing swing motion via the coupling member (27) and the operation of the eccentric rotary piston mechanism (20) is carried out. During that operation, the coupling member (27) comes into surface contact with both the annular piston (22) and the blade (23), as in each of the foregoing aspects of the present invention.

The present invention provides, as a sixth aspect according to first aspect, a rotary fluid machine which is characterized in that:

the cylinder (21) is firmly fixed to the casing (10); and the annular piston (22) is coupled to the driving mechanism (30).

In the sixth aspect of the present invention, the cylinder (21) having the cylinder chamber (C1, C2) becomes a stationary side and the annular piston (22) in the cylinder chamber (C1, C2) becomes a movable side. Because of this, the annular piston (22) advances and withdraws with respect to the blade (23) which is integral with the cylinder (21) and whose position is fixed while executing swing motion via the coupling member (27) and the operation of the eccentric rotary piston mechanism (20) is carried out. During that operation, the coupling member (27) comes into surface contact with both the annular piston (22) and the blade (23), as in each of the foregoing aspects of the present invention.

The present invention provides, as a seventh aspect according to the first aspect, a rotary fluid machine which is characterized in that:

the cylinder (21) has an outer cylinder (24) and an inner cylinder (25), the outer and inner cylinders (24, 25) defining the cylinder chamber (C1, C2), and an end plate (26) coupled to an axial end of each of the outer and inner cylinders (24, 25); and the outer cylinder (24), the inner cylinder (25), and the end plate (26) are integrated with each other.

In the seventh aspect of the present invention, the cylinder (21), formed by integrating the outer cylinder (24) and the inner cylinder (25) with the end plate (26), is employed. This therefore increases the strength of the cylinder (21).

The present invention provides, as an eighth aspect according to the seventh aspect, a rotary fluid machine which is characterized in that a compliance mechanism (29) is provided which reduces an axial gap between an end surface of the annular piston (22) and the end plate (26).

In the eighth aspect of the present invention, the compliance mechanism (29) reduces an axial gap which may be created by high pressure of gas in the cylinder chamber (C1, C2) between the end surface of the annular piston (22) and the end plate (26). This therefore impedes the leakage of gas from the axial gap.

The present invention provides, as a ninth aspect according to the first to aspect, a rotary fluid machine which is characterized in that:

the cylinder (21) has an outer cylinder (24) and an inner cylinder (25), the outer and inner cylinders (24, 25) defining the cylinder chamber (C1, C2); and the outer cylinder (24), the inner cylinder (25), and the blade (23) are integrated with each other.

In the ninth aspect of the present invention, the cylinder (21), formed by integrating the outer cylinder (24) and the inner cylinder (25) with the blade (23), is employed. This therefore simplifies the configuration of the cylinder (21).

The present invention provides, as a tenth aspect according to any one of the first to fourth aspects, a rotary fluid machine which is characterized in that:

the driving mechanism (30) has an electric motor (30) and a driving shaft (33) coupled to the electric motor (30);

the driving shaft (33) has an eccentric part (33*a*) off-centered from the center of rotation, the eccentric part (33*a*) being coupled to either the cylinder (21) or the annular piston (22); and the driving shaft (33) is held, at both axial side portions of the eccentric part (33*a*), on the casing (10) through bearing parts (16*a*, 17*a*).

In the tenth aspect of the present invention, since the driving shaft (33) for driving the eccentric rotary piston mechanism (20) rotates while being held, at the both axial side portions of the eccentric part (33*a*) coupled to either the cylinder (21) or the annular piston (22) whichever is a movable side, on the casing (10) through the bearing parts (16*a*, 17*a*), this stabilizes the operation of the eccentric rotary piston mechanism (20).

The present invention provides, as a thirteenth aspect according to the first aspect, a rotary fluid machine which is characterized in that a heat insulating space (S3) is formed around the outer periphery of the eccentric rotary piston mechanism (20). The heat insulating space (S3) is a space where low pressure gas is accumulated, for example.

In the thirteenth aspect of the present invention, in the case where the eccentric rotary piston mechanism (20) is implemented by, for example, a compression mechanism (20), it is possible to impede the transfer of heat from the high pressure space (S2) of the casing (10) to low pressure refrigerant which is drawn into the compression mechanism (20).

The present invention provides, as a fourteenth aspect according to the first to aspect, a rotary fluid machine which is characterized in that the eccentric rotary piston mechanism (20) is a compression mechanism for drawing fluid and compressing same.

In the fourteenth aspect of the present invention, in the case where the eccentric rotary piston mechanism (20) is a compression mechanism, it is possible to prevent a drop in the compression efficiency due to gas leakage, and the occurrence of wear and seizure of the annular piston (22) and the blade (23).

The present invention provides, as a fifteenth aspect according to the fourteenth aspect, a rotary fluid machine which is characterized in that:

- the driving mechanism (30) is formed by an electric motor for driving the compression mechanism (20);
- the casing (10) is so configured as to house the compression mechanism (20) and the electric motor (30);
- a low pressure space (S1) in fluid communication with a suction side of the compression mechanism (20) and a high pressure space (S2) in fluid communication with a discharge side of the compression mechanism (20) are formed in the casing (10); and
- the electric motor (30) is disposed in the low pressure space (S1).

In the fifteenth aspect of the present invention, after having flowed into the low pressure space (S1) of the casing (10), suction gas is drawn into the compression mechanism (20). The gas drawn into the compression mechanism (20) is compressed by the compression mechanism (20) to a high pressure, flows out to the high pressure space (S2) of the casing (10), and is discharged out of the casing (10). In the fifteenth aspect of the present invention, since the electric motor (30) is disposed in the low pressure space (S1), this causes suction gas to flow around the electric motor (30).

The present invention provides, as a sixteenth aspect, a rotary fluid machine whose prerequisite configuration is the same as that of the rotary fluid machine of the first aspect, the rotary fluid machine of the sixteenth aspect being characterized in that: the cylinder (21) is provided with the blade (23); a coupling member (27) by which the annular piston (22) and the blade (23) are mutually movably coupled together is provided; the coupling member (27) has a first sliding surface (P1) against the annular piston (22) and a second sliding surface (P2) against the blade (23); and the outer cylinder chamber (C1) formed on the outside of the annular piston (22) and the inner cylinder chamber (C2) formed on the inside of the annular piston (22) differ from each other in suction shutoff angle. Here, by the "suction shutoff angle" is meant either the angle of the annular piston (22) or the angle of the cylinder (21) at which a suction process is completed in the cylinder chamber (C1, C2), in other words, the angle at which a compression process is started.

In addition, the present invention provides, as a seventeenth aspect according to the sixteenth aspect, a rotary fluid machine which is characterized in that the suction shutoff angle of the outer cylinder chamber (C1) is greater than the suction shutoff angle of the inner cylinder chamber (C2).

In these sixteenth and seventeenth aspects of the present invention, the difference in compression volume between the outer cylinder chamber (C1) and the inner cylinder chamber (C2) can be reduced by differentiating the outer and inner cylinder chambers (C1, C2) from each other in suction shutoff angle (especially by making the suction shutoff angle of the outer cylinder chamber (C1) greater than that of the inner cylinder chamber (C2)). When the compression volume difference is great, it is conceivable for some vibration to be generated due to the difference between the amplitude of torque fluctuations in the outer cylinder chamber (C1) and the amplitude of torque fluctuations in the inner cylinder chamber (C2). In the sixteenth and seventeenth aspects of the present invention, however, the difference between the amplitude of torque fluctuations in the outer cylinder chamber (C1) and the amplitude of torque fluctuations in the inner cylinder chamber (C2) is lessened, thereby stabilizing the operation of the mechanism (20).

The present invention provides, as an eighteenth aspect, a rotary fluid machine whose prerequisite configuration is the same as that of the rotary fluid machine of the first aspect, the rotary fluid machine of the eighteenth aspect being characterized in that: the cylinder (21) is provided with the blade (23); a coupling member (27) by which the annular piston (22) and the blade (23) are mutually movably coupled together is provided; the coupling member (27) has a first sliding surface (P1) against the annular piston (22) and a second sliding surface (P2) against the blade (23); the annular piston (22) is formed into a C-shape, i.e., a split-ring shape having at a portion thereof a split; the blade (23) is configured to be inserted through the split of the annular piston (22) so that the blade (23) extends from the inner peripheral wall surface to the outer peripheral wall surface of the annular cylinder chamber (C1, C2); the coupling member (27) is formed by a swinging bush (27) having a blade groove (28) which advanceably and withdrawably holds the blade (23) and a circular arc-shaped outer peripheral surface which is swingably held in the split by the annular piston (22); and the outer cylinder chamber (C1) formed on the outside of the annular piston (22) and the inner cylinder chamber (C2) formed on the inside of the annular piston (22) differ from each other in suction shutoff angle.

In addition, the present invention provides, as a nineteenth aspect according to the eighteenth aspect, a rotary fluid machine which is characterized in that the suction shutoff angle of the outer cylinder chamber (C1) is greater than the suction shutoff angle of the inner cylinder chamber (C2).

In these eighteenth and nineteenth aspects of the present invention, like the sixteenth and seventeenth aspects, the difference in compression volume between the outer cylinder chamber (C1) and the inner cylinder chamber (C2) can be reduced by differentiating the outer and inner cylinder chambers (C1, C2) from each other in suction shutoff angle (especially by making the suction shutoff angle of the outer cylinder chamber (C1) greater than that of the inner cylinder chamber (C2)). Therefore, like the second and third aspects, the difference between the amplitude of torque fluctuations in the outer cylinder chamber (C1) and the amplitude of torque fluctuations in the inner cylinder chamber (C2) is lessened, thereby stabilizing the operation of the mechanism (20).

In addition, the present invention provides, as a twentieth aspect, a rotary fluid machine comprising:

an eccentric rotary piston mechanism (20) including: a cylinder (21) having an annular cylinder chamber (C1, C2); an annular piston (22) housed, in an eccentric fashion relative to the cylinder (21), in the cylinder chamber (C1, C2) and dividing the cylinder chamber (C1, C2) into an outer cylinder chamber (C1) and an inner cylinder chamber (C2); and a blade (23) disposed in the cylinder chamber (C1, C2) and dividing each of the outer and inner cylinder chambers (C1, C2) into a first chamber (C1-Hp, C2-Hp) and a second chamber (C1-Lp, C2-Lp), the cylinder (21) and the annular piston (22) relatively executing eccentric rotary motion;

a driving mechanism (30) which includes a driving shaft for driving the eccentric rotary piston mechanism (20); and a casing (10) in which to house the eccentric rotary piston mechanism (20).

And, the rotary fluid machine of the twentieth aspect is characterized in that:

the cylinder (21) is provided with the blade (23);

a coupling member (27) by which the annular piston (22) and the blade (23) are mutually movably coupled together is provided;

the coupling member (27) has a first sliding surface (P1) against the annular piston (22) and a second sliding surface (P2) against the blade (23);

the annular piston (22) is formed into a C-shape, i.e., a split-ring shape having at a portion thereof a split;

the blade (23) is configured to be inserted through the split of the annular piston (22) so that the blade (23) extends from the inner peripheral wall surface to the outer peripheral wall surface of the annular cylinder chamber (C1, C2);

the coupling member (27) is formed by a swinging bush (27) having a blade groove (28) which advanceably and withdrawably holds the blade (23) and a circular arc-shaped outer peripheral surface which is swingably held in the split by the annular piston (22);

the driving shaft (33) is provided with an eccentric part (33*a*) off-centered from the center of axle of the driving shaft (33) by an predetermined amount of eccentricity, the eccentric part (33*a*) being formed in a portion located in the cylinder chamber (C1, C2);

the driving shaft (33) is held, at both axial side portions of the eccentric part (33*a*), on the casing (10) through bearing parts (16*a*, 17*a*); and the eccentric part (33*a*) is formed to have a diameter greater than that of the both axial side portions of the eccentric part (33*a*).

Advantageous Effects of the Invention

According to the first aspect of the present invention, during the operation of the eccentric rotary piston mechanism (20), the coupling member (27) substantially comes into surface contact, at the sliding surfaces (P1, P2), with the annular piston (22) and the blade (23), thereby making it possible to reduce the load per unit of area which is applied to the contact portions. Accordingly, when the blade (23) and the annular piston (22) slide via the coupling member (27) during the operation, the contact portions are less subjected to wear and seizure. In addition, because of the surface contact of the coupling member (27) with the annular piston (22) and the blade (23) at the sliding surfaces (P1, P2), the occurrence of gas leakage between the first chamber (C1-Hp, C2-Hp) and the second chamber (C1-Lp, C2-Lp) is prevented from taking place.

In addition, according to the first aspect of the present invention, the arrangement that the blade (23) is mounted integrally on the cylinder (21) impedes the occurrence of abnormal concentrated load and stress concentration during the operation of the eccentric rotary piston mechanism (20), thereby providing a benefit that the reliability of the mechanism is enhanced.

In addition, according to the first aspect of the present invention, the swinging bush (27), which has the blade groove (28) which advanceably and withdrawably holds the blade (23) and the circular arc-shaped outer peripheral surface which is swingably held in the split by the annular piston (22), is used as the coupling member (27), thereby making it possible to prevent the configuration of the coupling part from becoming complicated, in addition to preventing, without fail, the occurrence of gas leakage and wear and seizure of the members during the operation. This therefore prevents the mechanism from increasing in size and prevents therefore costs from increasing.

In addition, in accordance with the first aspect of the present invention, the swing center of the swinging bush (27) is displaced more radially inwardly than the center of the wall thickness center of the annular piston (22), thereby making it possible to reduce reexpansion loss even when the swinging bush (27) is of the symmetrical type. As a result, the operating efficiency is enhanced. Therefore, in the configuration in which the annular piston (22) and the blade (23) are coupled together by the swinging bush (27), the swinging bush (27) can be configured such that it becomes superior especially in the efficient aspect of the eccentric rotary piston mechanism (20).

In addition, the swinging bush (27) of the symmetrical type can be used for the purpose of reexpansion loss reduction, without having to use an asymmetrical type one. This makes it possible to avoid malassembly of the mechanism.

According to the fifth aspect of the present invention, in the configuration in which the cylinder (21) is a movable side and the annular piston (22) is a stationary side, the operation of the cylinder (21) with respect to the annular piston (22) is carried out while at the same time the coupling member (27) is being in surface contact with the annular piston (22) and the blade (23). Therefore, in the configuration in which the cylinder (21) is movable, the occurrence of gas leakage, and wear and seizure of the members is prevented.

According to the sixth aspect of the present invention, in the configuration in which the cylinder (21) is a stationary side and the annular piston (22) is a movable side, the operation of the annular piston (22) with respect to the cylinder (21) is carried out while at the same time the coupling member (27) is being in surface contact with the annular piston (22) and the blade (23). Therefore, in the configuration in which the annular piston (22) is movable, the occurrence of gas leakage, and wear and seizure of the members is prevented.

According to the seventh aspect of the present invention, the cylinder (21), formed by integrating the outer cylinder (24) and the inner cylinder (25) with the end plate (26), is employed, thereby increasing the strength of the cylinder (21). This therefore provides a benefit that the designing of the mechanism (20) of high strength is facilitated.

According to the eighth aspect of the present invention, the compliance mechanism (29), configured to reduce an axial gap possibly created between the end surface of the annular piston (22) and the end plate (26), is provided. This impedes the occurrence of gas leakage from the axial gap, and the operation is carried out at higher efficiency.

According to the ninth aspect of the present invention, the cylinder, formed by integrating the outer cylinder (24) and the inner cylinder (25) with the blade (23), is employed, thereby simplifying the configuration of the cylinder (21). This therefore makes it possible to provide compact design.

According to the tenth aspect of the present invention, the driving shaft (33) for driving the eccentric rotary piston mechanism (20) rotates while being held, at the both axial side portions of the eccentric part (33*a*) coupled to either the cylinder (21) or the annular piston (22) whichever is a movable side, on the casing (10) through the bearing parts (16*a*, 17*a*), thereby stabilizing the operation of the eccentric rotary piston mechanism (20). As a result, the reliability of the mechanism (20) is improved.

According to the thirteenth aspect of the present invention, the heat insulating space (S3) is provided around the outer periphery of the eccentric rotary piston mechanism (20). Therefore, in the case where the eccentric rotary piston mechanism (20) is implemented by, for example, a compression mechanism (20), it is possible to impede the transfer of heat from the high pressure space (S2) of the casing (10) to low pressure refrigerant which is drawn into the compression mechanism (20), thereby preventing the deterioration of performance due to suction superheat loss.

According to the fourteenth aspect of the present invention, it is ensured that, in the case where the eccentric rotary piston mechanism (20) is implemented by a compression mechanism, the occurrence of a compression efficiency drop due to gas leakage and wear, and seizure of the annular piston (22) and the blade (23) is prevented without fail.

According to the fifteenth aspect of the present invention, the low pressure space (S1) in fluid communication with the suction side of the compression mechanism (20) and the high pressure space (S2) in fluid communication with the discharge side of the compression mechanism (20) are defined in the casing (10), and the electric motor (30) is disposed in the low pressure space (S1).

There is a problem with conventional compressors of a so-called high pressure dome type having a high pressure casing space. More specifically, the electric motor becomes deficient in performance, resulting in a drop in the reliability, when producing large capacity compressors on a commercial basis, the reason for which is explained as follows. If the outer diameter of the electric motor is D and the axial length thereof is L, then the output of the electric motor is proportional to $D^2 \times L$ and the surface area of the electric motor is approximately proportional to $D \times L$, so that when increasing the output the heat transferring area (surface area) will decrease with respect to the heat generation rate which increases in proportion to the output, and cooling deficiency takes place.

On the other hand, it may be arranged such that the electric motor is disposed in a low pressure space so that the electric motor is cooled by low pressure gas. However, if the electric motor is simply disposed in a low pressure space, this causes gas refrigerant to be discharged to outside the compressor directly from the compression mechanism, in other words oil droplet-containing gas refrigerant is discharged, with oil droplets not separated therefrom. This represents problems one of which is that the efficiency of the heat exchanger falls due to an increase in the circulation amount of oil in the refrigerant circuit and another of which is that the separate provision of an oil separator is required for avoiding an increase in the circulation amount of oil.

On the other hand, in the fifteenth aspect of the present invention, the low pressure space (S1) in fluid communication with the suction side of the compression mechanism (20) and the high pressure space (S2) in fluid communication with the discharge side of the compression mechanism (20) are provided in the casing (10) and the electric motor (30) is disposed in the low pressure space (S1). This arrangement allows suction gas to the compression mechanism (20) to flow around the electric motor (30), thereby efficiently cooling the electric motor (30). In addition, since the high pressure space (S2) in fluid communication with the discharge side of the compression mechanism (20) is defined in the casing, thereby providing a configuration in which discharge gas such as refrigerant is expelled from the compression mechanism (20) by way of the high pressure space (S2). Accordingly, even when discharge gas contains, upon being discharged from the compression mechanism (20), a large amount of lubricant, its lubricant content is separated in the high pressure space (S2). Consequently, the discharge gas is discharged out of the compressor (1) after undergoing lubricant separation, thereby making it possible to reduce the circulation amount of oil in the refrigerant circuit, to eliminate lack of oil in the compressor (1), and to eliminate the need for the provision of an oil separator for eliminating lack of oil in the compressor (1).

According to the sixteenth aspect of the present invention, the outer and inner cylinder chambers (C1, C2) differ from each other in suction shutoff angle, thereby making it possible to make adjustments to the ratio of the compression volume of the outer cylinder chamber (C1) to the compression volume of the inner cylinder chamber (C2).

According to the seventeenth aspect of the present invention, the suction shutoff angle of the outer cylinder chamber (C1) is made greater than the suction shutoff angle of the inner cylinder chamber (C2), thereby making it possible to reduce the difference in compression volume between the outer cylinder chamber (C1) and the inner cylinder chamber (C2). This therefore reduces the difference between the amplitude of torque fluctuations in the outer cylinder chamber (C1) and the amplitude of torque fluctuations in the inner cylinder chamber (C2) and, as a result, the operation of the mechanism (20) is stabilized.

According to the eighteenth aspect of the present invention, the outer and inner cylinder chambers (C1, C2) differ from each other in suction shutoff angle, thereby making it possible to make adjustments to the ratio of the compression volume of the outer cylinder chamber (C1) to the compression volume of the inner cylinder chamber (C2). On the other hand, according to the nineteenth aspect of the present invention, the suction shutoff angle of the outer cylinder chamber (C1) is made greater than the suction shutoff angle of the inner cylinder chamber (C2), thereby making it possible to reduce the difference in compression volume between the outer cylinder chamber (C1) and the inner cylinder chamber (C2). This therefore reduces the difference between the amplitude of torque fluctuations in the outer cylinder chamber (C1) and the amplitude of torque fluctuations in the inner cylinder chamber (C2) and, as a result, the operation of the mechanism (20) is stabilized.

DETAILED DESCRIPTION OF THE INVENTION

In the following, embodiments of the present invention are described in detail with reference to the accompanying drawings.

FIRST EMBODIMENT OF THE INVENTION

Figure 1:
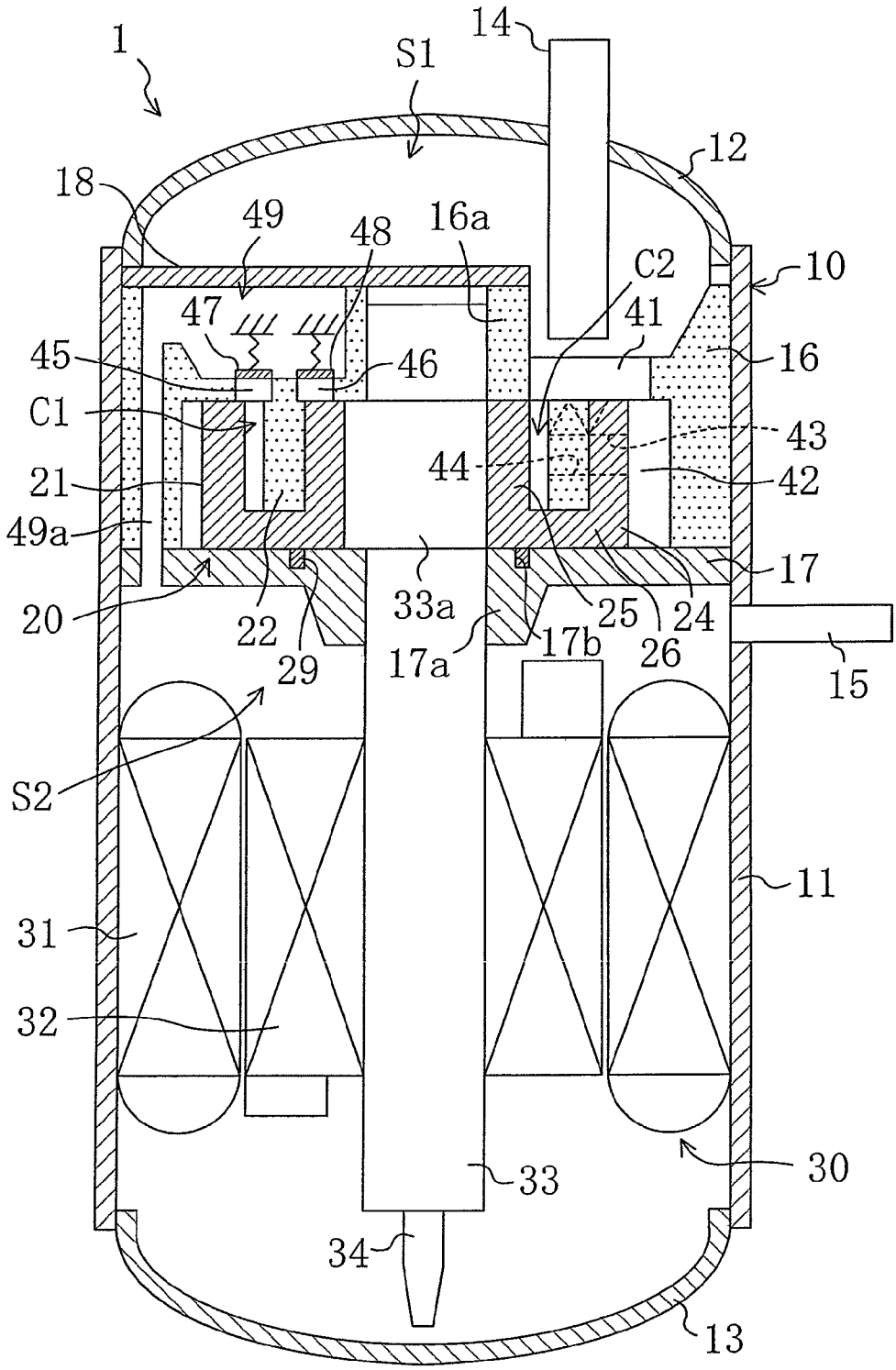
FIG. 1 is a longitudinal cross sectional view of a rotary compressor according to a first embodiment of the present invention.

A first embodiment of the present invention is concerned with a rotary compressor. Referring first to FIG. 1, the rotary compressor (1) of the first embodiment has a compression mechanism (eccentric rotary piston mechanism) (20) and an electric motor (driving mechanism) (30) which are housed in a casing (10). The rotary compressor (1) is of the hermetically sealed type. For example, the compressor (1) is used to compress refrigerant drawn from an evaporator and discharge the compressed refrigerant to a condenser in a refrigerant circuit of an air conditioning system.

The casing (10) is made up of a cylindrical trunk part (11), an upper end plate (12) which is firmly fixed to an upper end of the trunk part (11), and a lower end plate (13) which is firmly fixed to a lower end of the trunk part (11). The upper end plate (12) is provided with a suction pipe (14) which is extended completely through the end plate (12) and the trunk part (11) is provided with a discharge pipe (15) which is extended completely through the trunk part (11).

The compression mechanism (20) is configured between an upper housing (16) and a lower housing (17) which are firmly fixed to the casing (10). The compression mechanism (20) includes a cylinder (21) which has an annular cylinder chamber (C1, C2), an annular piston (22) which is disposed in the cylinder chamber (C1, C2), and a blade (23) which divides each cylinder chamber (C1, C2) into a high pressure chamber (compression chamber) (C1-Hp, C2-Hp) serving as a first chamber and a low pressure chamber (suction chamber) (C1-Lp, C2-Lp) serving as a second chamber. The cylinder (21) and the annular piston (22) are configured such that they relatively execute eccentric rotary motion. In the first embodiment, the cylinder (21) having the cylinder chamber (C1, C2) is a movable side, while the annular piston (22) disposed in the cylinder chamber (C1, C2) is a stationary side.

The electric motor (30) is provided with a stator (31) and a rotor (32). The stator (31) underlies the compression mechanism (20), and is firmly fixed to the trunk part (11) of the casing (10). A driving shaft (33) is coupled to the rotor (32) so that the driving shaft (33) and the rotor (32) rotate together. The driving shaft (33) is extended vertically through the cylinder chamber (C1, C2).

The driving shaft (33) is provided with an oil supplying path (diagrammatical representation omitted) which radially extends in the inside of the driving shaft (33). The driving shaft (33) is provided, at its lower end, with an oil supplying pump (34). And the oil supplying path extends upward from the oil supplying pump (34) to the compression mechanism (20). As a result of this arrangement, lubricant accumulated on the bottom of the casing (10) is supplied by the oil supplying pump (34) to the sliding part of the compression mechanism (20) by way of the oil supplying path.

The driving shaft (33) is provided, at a portion thereof situated within the cylinder chamber (C1, C2), with an eccentric part (33*a*). The eccentric part (33*a*) is formed such that it has a greater diameter than that of the upper and lower portions of the eccentric part (33*a*). The eccentric part (33*a*) is off-centered from the center of axle of the driving shaft (33) by an predetermined amount of eccentricity.

The cylinder (21) is made up of an outer cylinder (24) and an inner cylinder (25). The outer cylinder (24) and the inner cylinder (25) are coupled together at their lower ends by an end plate (26), so that they are integrated with each other. The inner cylinder (25) is slidably fitted into the eccentric part (33*a*) of the driving shaft (33).

The annular piston (22) is formed integrally with the upper housing (16). In addition, the upper housing (16) and the lower housing (17) are respectively provided with bearing parts (16*a*, 17*a*) for supporting the driving shaft (33). In this way, the compressor (1) of the present embodiment is formed into a pass-through shaft configuration in which the driving shaft (33) is extended vertically through the cylinder chamber (C1, C2) and both the radial side portions of the eccentric part (33*a*) are supported on the casing (10) through the bearing parts (16*a*, 17*a*).

Figure 2:
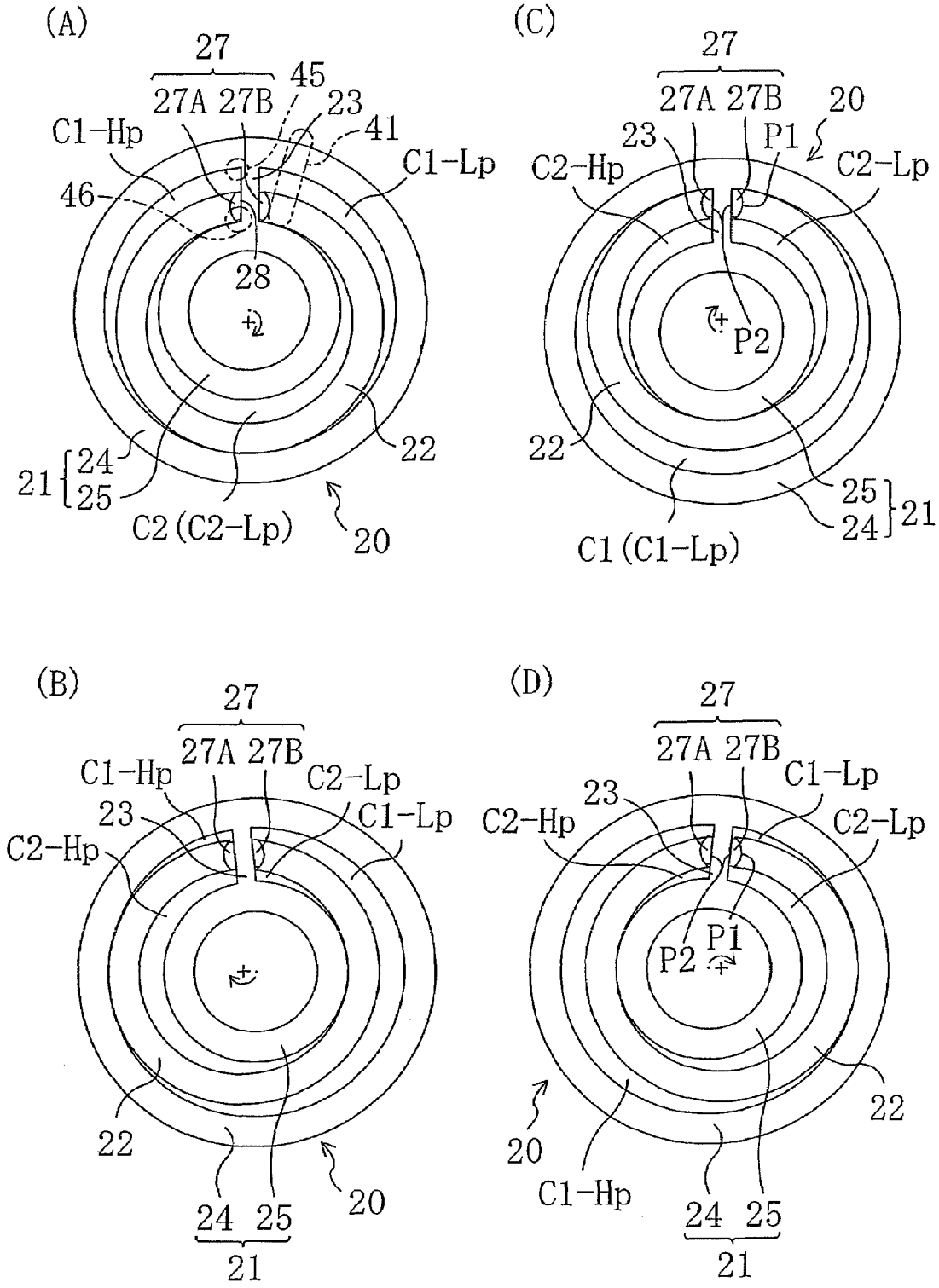
FIG. 2 is a transverse cross sectional view which illustrates the operation of a compression mechanism.

The compression mechanism (20) is provided with a swinging bush (27) serving as a coupling member for mutually movably coupling together the annular piston (22) and the blade (23). The annular piston (22) is formed into a C-shape, i.e., a split-ring shape having at a portion thereof a split. The blade (23) is formed such that it is inserted through the split of the annular piston (22) to extend, on a line in the radial direction of the cylinder chamber (C1, C2), from the inner peripheral wall surface of the cylinder chamber (C1, C2) (i.e., the outer peripheral surface of the inner cylinder (25)) to the outer peripheral wall surface of the cylinder chamber (C1, C2) (i.e., the inner peripheral surface of the outer cylinder (24)). The blade (23) is firmly fixed to both the outer cylinder (24) and the inner cylinder (25). The annular piston (22) and the blade (23) are coupled together at the split of the annular piston (22) by the swinging bush (27). In addition, as shown in FIG. 2, the blade (23) may be formed integrally with both the outer cylinder (24) and the inner cylinder (25). Alternatively, a separate member may be attached to both the cylinders (24, 25). Additionally, the blade (23) may be mounted such that it travels in the longitudinal direction thereof.

The inner peripheral surface of the outer cylinder (24) and the outer peripheral surface of the inner cylinder (25) are concentrically arranged cylindrical surfaces between which is defined the cylinder chamber (C1, C2). The annular piston (22) is formed such that it has an outer peripheral surface having a smaller diameter than that of the inner peripheral surface of the outer cylinder (24), and an inner peripheral surface having a greater diameter than that of the outer peripheral surface of the inner cylinder (25). As a result of this arrangement, the outer cylinder chamber (C1) is formed between the outer peripheral surface of the annular piston (22) and the inner peripheral surface of the outer cylinder (24), while the inner cylinder chamber (C2) is formed between the inner peripheral surface of the annular piston (22) and the outer peripheral surface of the inner cylinder (25).

In addition, when the annular piston (22) and the cylinder (21) are in a state in which the outer peripheral surface of the annular piston (22) and the inner peripheral surface of the outer cylinder (24) substantially come into contact with each other at one point (i.e., a state in which, although there is technically defined a gap of micron order, refrigerant leakage in the gap may be negligible), the inner peripheral surface of the annular piston (22) and the outer peripheral surface of the inner cylinder (25) are substantially brought into contact with each other at a position 180 degrees out of phase relative to the contact point.

The swinging bush (27) is made up of a discharge side bush (27A) which is located on the side of the high pressure chamber (C1-Hp, C2-Hp) with respect to the blade (23) and a suction side bush (27B) which is located on the side of the low pressure chamber (C1-Lp, C2-Lp) with respect to the blade (23). Both the discharge side bush (27A) and the suction side bush (27B) are approximately semi-circular in cross section and are identical in shape with each other, and they are arranged such that their flat surfaces are located opposite each other. And the space defined between the opposing surfaces of the bushes (27A, 27B) constitutes a blade groove (28).

The blade (23) is inserted in the blade groove (28). The swinging bushes (27A, 27B) each have a flat surface (i.e., a second sliding surface (P2) of FIG. 2(C)) which substantially comes into surface contact with the blade (23), and a circular arc-shaped outer peripheral surface (i.e., a first sliding surface (P1)) which comes substantially into surface contact with the annular piston (22). The swinging bushes (27A, 27B) are so configured as to allow the blade (23) to move back and forth in the blade groove (28) in the surface direction of the blade (23), with the blade (23) caught in the blade groove (28). The swinging buses (27A, 27B) are configured such that they, at the same time, swing integrally with the blade (23) with respect to the annular piston (22). Accordingly, the swinging bush (27) is configured such that the blade (23) and the annular piston (22) become relatively swingable about the central point of the swinging bush (27) as a swing center and, in addition, the blade (23) is able to advance and withdrawn in the surface direction of the blade (23) with respect to the annular piston (22).

In the present embodiment, the description has been made with respect to the above example case where the buses (27A, 27B) are formed separately from each other. Alternatively, the buses (27A, 28B) may be integrally formed with each other by coupling portions of the buses (27A, 28B).

In the above configuration, when the driving shaft (33) rotates, the outer cylinder (24) and the inner cylinder (25) swing about the central point of the swinging bush (27) as a swing center, while the blade (23) travels back and forth in the blade groove (28). This swing operation causes the point of contact between the annular piston (22) and the cylinder (21) to shift in sequence from FIG. 2(A) to FIG. 2(D). At this time, the outer cylinder (24) and the inner cylinder (25) orbit the driving shaft (33), but they do not rotate.

The upper housing (16) is provided, at a position thereof beneath the suction pipe (14), with a suction opening (41). The suction opening (41) is formed in the shape of an elongate hole extending over from the inner cylinder chamber (C2) to a suction space (42) formed around the outer periphery of the outer cylinder (24). The suction opening (41) is extended completely through the upper housing (16) in the axial direction thereof, and brings the low pressure chamber (C1-Lp, C2-Lp) of the cylinder chamber (C1, C2) and the suction space (42) into fluid communication with the space above the upper housing (16) which is a low pressure space (S1). In addition, the outer cylinder (24) is provided with a through-hole (43) which brings the suction space (42) and the low pressure chamber (C1-Lp) of the outer cylinder chamber (C1) into fluid communication with each other and the annular piston (22) is provided with a through-hole (44) which brings the low pressure chamber (C1-Lp) of the outer cylinder chamber (C1) and the low pressure chamber (C2-Lp) of the inner cylinder chamber (C2) into fluid communication with each other.

In addition, the outer cylinder (24) and the annular piston (22) are desirably chamfered wedgewise at their upper end portions corresponding to the suction opening (41), as indicated by broken line of FIG. 1. This makes it possible to allow refrigerant to be efficiently drawn into the low pressure chamber (C1-Lp, C2-Lp).

The upper housing (16) is provided with discharge openings (45, 46). These discharge openings (45, 46) are each extended completely through the upper housing (16) in the axial direction thereof. The lower end of the discharge opening (45) is opened such that it faces towards the high pressure chamber (C1-Hp) of the outer cylinder chamber (C1), while the lower end of the discharge opening (46) is opened such that it faces towards the high pressure chamber (C2-Hp) of the inner cylinder chamber (C2). On the other hand, the upper ends of the discharge openings (45, 46) fluidly communicate, through discharge valves (reed valves) (47, 48) for opening and closing the discharge openings (45, 46), with a discharge space (49).

The discharge space (49) is defined between the upper housing (16) and a cover plate (18). A discharge passageway (49*a*) is formed through the upper and lower housings (16, 17). The discharge passageway (49*a*) fluidly communicates with a space below the lower housing (17) (i.e., a high pressure space (S2)) from the discharge space (49).

On the other hand, the lower housing (17) is provided with a seal ring (29). The seal ring (29) is mounted in an annular groove (17*b*) of the lower housing (17). The seal ring (29) is brought into pressure contact with the lower surface of the end plate (26) of the cylinder (21). In addition, it is arranged such that, in the contact surface between the cylinder (21) and the lower housing (17), high pressure lubricant is introduced to a radial inner portion of the seal ring (29). In the way as described above, the seal ring (29) constitutes a compliance mechanism capable of reducing a radial gap between the lower end surface of the annular piston (22) and the end plate (26) of the cylinder (21).

Running Operation

The running operation of the compressor (1) is described below.

When the electric motor (30) is activated, rotation of the rotor (32) is transmitted through the driving shaft (33) to the outer and inner cylinders (24, 25) of the compression mechanism (20). Then, the blade (23) executes reciprocating motion, i.e., advance/withdrawal motion, between the swinging bushes (27A, 27B) and performs, integrally with the swinging bushes (27A, 27B), a swing operation with respect to the annular piston (22). At that time, the swinging bushes (27A, 27B) substantially come into surface contact with the annular piston (22) and the blade (23) at the sliding surfaces (P1, P2). Then, the outer cylinder (24) and the inner cylinder (25) execute orbital motion while executing a swing motion with respect to the annular piston (22), and the compression mechanism (20) performs a predetermined compression operation.

More specifically, in the outer cylinder chamber (C1), the volume of the low pressure chamber (C1-Lp) is almost at its minimum in the state shown in FIG. 2(D). From this state, the driving shaft (33) rotates in a clockwise direction in the drawing, thereby causing the change of state from the above state to the state shown in FIG. 2(A), then to the state shown in FIG. 2(B), and then to the state of FIG. 2(C). When the volume of the low pressure chamber (C1-Lp) increases with the change of state, refrigerant is drawn, by way of the suction pipe (14), the low pressure space (S1), and the suction opening (41), into the low pressure chamber (C1-Lp). At this time, the refrigerant is not only drawn directly into the low pressure chamber (C1-Lp) from the suction opening (41) but a part of the refrigerant also enters the suction space (42) from the suction opening (41) and is drawn through the through-hole (43) into the low pressure chamber (C1-Lp) from the suction space (42).

When the outer cylinder chamber (C1) again enters the state shown in FIG. 2(D) upon completion of one rotation of the driving shaft (33), the sucking-in of refrigerant into the low pressure chamber (C1-Lp) comes to a complete. Then, this low pressure chamber (C1-Lp) next becomes a high pressure chamber (C1-Hp) in which refrigerant is compressed and a low pressure chamber (C1-Lp) is newly formed across the blade (23). When the driving shaft (33) is further rotated, the sucking-in of refrigerant is repeatedly carried out in the low pressure chamber (C1-Lp), while the volume of the high pressure chamber (C1-Hp) decreases and refrigerant is compressed in the high pressure chamber (C1-Hp). When the pressure of the high pressure chamber (C1-Hp) becomes a predetermined value and the difference in pressure between the high pressure chamber (C1-Hp) and the discharge space (49) reaches a preset value, a discharge valve (47) is placed in the open state by the high pressure refrigerant in the high pressure chamber (C1-Hp) and the high pressure refrigerant flows out to the high pressure space (S2) from the discharge space (49) by way of the discharge passageway (49*a*).

In the inner cylinder chamber (C2), the volume of the low pressure chamber (C2-Lp) is almost at its minimum in the state shown in FIG. 2(B). From this state, the driving shaft (33) rotates in a clockwise direction in the drawing, thereby causing the change of state from the above state to the state shown in FIG. 2(C), then to the state shown in FIG. 2(D), and then to the state of FIG. 2(A). When the volume of the low pressure chamber (C2-Lp) increases with the change of state, refrigerant is drawn, by way of the suction pipe (14), the low pressure space (S1), and the suction opening (41), into the low pressure chamber (C2-Lp). At this time, the refrigerant is not only drawn directly into the low pressure chamber (C2-Lp) from the suction opening (41) but a part of the refrigerant also enters the suction space (42) from the suction opening (41) and is drawn, through the through-hole (43), the low pressure chamber (C1-Lp) of the outer cylinder chamber and the through-hole (44), into the low pressure chamber (C2-Lp) of the inner cylinder chamber (C2) from the suction space (42).

When the inner cylinder chamber (C2) again enters the state shown in FIG. 2(B) upon completion of one rotation of the driving shaft (33), the sucking-in of refrigerant into the low pressure chamber (C2-Lp) comes to a complete. Then, this low pressure chamber (C2-Lp) next becomes a high pressure chamber (C2-Hp) in which refrigerant is compressed and a low pressure chamber (C2-Lp) is newly formed across the blade (23). When the driving shaft (33) is further rotated, the sucking-in of refrigerant is repeatedly carried out in the low pressure chamber (C2-Lp), while the volume of the high pressure chamber (C2-Hp) decreases and refrigerant is compressed in the high pressure chamber (C2-Hp). When the pressure of the high pressure chamber (C2-Hp) becomes a predetermined value and the difference in pressure between the high pressure chamber (C2-Hp) and the discharge space (49) reaches a preset value, a discharge valve (48) is placed in the open state by the high pressure refrigerant in the high pressure chamber (C2-Hp) and the high pressure refrigerant flows out to the high pressure space (S2) from the discharge space (49) by way of the discharge passageway (49*a*).

In the way as described above, the high pressure refrigerant, after compression in both the outer cylinder chamber (C1) and the inner cylinder chamber (C2) and flowing out to the high pressure space (S2), is discharged from the discharge pipe (15), is subjected to condensation, expansion, and evaporation processes in the refrigerant circuit, and thereafter is drawn again into the compressor (1).

Advantageous Effects of the First Embodiment

In the first embodiment, as a coupling member for coupling together the annular piston (22) and the blade (23), the swinging bush (27) is provided. Since it is configured such that the swinging bush (27) substantially comes into surface contact, at the sliding surfaces (P1, P2), with the annular piston (22) and the blade (23), this prevents the annular piston (22) and the blade (23) from wearing and further prevents their contact parts from undergoing seizure during the operation.

In addition, because of the provision of the swinging bush (27) and of the arrangement that the swinging bush (27) comes into surface contact with the annular piston (22) and the blade (23), the sealability of the contact parts is also excellent. This therefore prevents the occurrence of a drop in the compression efficiency due to refrigerant leakage into the low pressure chamber (C1-Lp, C2-Lp) from the high pressure chamber (C1-Hp, C2-Hp) in each of the outer cylinder chamber (C1) and the inner cylinder chamber (C2).

Furthermore, in accordance with the compressor (1) of the present embodiment, the torque fluctuations associated with the compression process in the outer cylinder chamber (C1) and the torque fluctuations associated with the compression process in the inner cylinder chamber (C2) are deviated 180 degrees in phase from each other, and the amplitude of the total torque curve becomes smaller in comparison with the single cylinder compressor. If the amplitude is great, the vibration and noise of the compressor (1) becomes problematic. Such a problem is avoided in the present embodiment. Besides, the configuration produces less noise. There is no need to employ soundproofing material and there is an effect of reducing costs.

In addition, in a conventional 2-cylinder type compressor with a two-tiered compression mechanism (see, for example, JP 2000-161276A), its configuration becomes complicated, thereby increasing costs. In the compressor (1) of the present embodiment, however, the provision of two cylinder chambers, i.e., the outer and inner cylinder chambers (C1, C2), in the single compression mechanism (20) provides the same performance that the aforesaid 2-cylinder type compressor accomplishes. Besides, the configuration can be simplified and the costs are held low. In addition, in the present embodiment, the bearing-to-bearing span can be made shorter than the 2-cylinder type compressor with a two-tiered compression mechanism, thereby reducing the deflection of the driving shaft. As a result, the operation becomes stabilized.

Furthermore, according to the configuration of the present embodiment, in the case where liquid back into the compressor (1) from an evaporator in the refrigerant circuit occurs due to a variation in the operating condition, if the high pressure of the high pressure chamber (C1-Hp, C2-Hp) of the cylinder chamber (C1, C2) abnormally increases, the seal ring (29) becomes deformed to thereby cause downward displacement of the cylinder (21). This allows liquid refrigerant to leak to the low pressure chamber (C1-Lp, C2-Lp) from the high pressure chambers (C1-Hp, C2-Hp), whereby the occurrence of liquid compression is also prevented. As a result, the failure probability of the compression mechanism (20) is lowered and its reliability is improved accordingly.

In addition, according to the first embodiment, the blade (23) is mounted integrally on the cylinder (21), wherein the blade (23) is held, at its both ends, on the cylinder (21). This therefore impedes application of an abnormal concentrated load to the blade (23) and stress concentration in the blade (23) during the operation. Consequently, the sliding parts are less subjected to damage, thereby enhancing the reliability of the mechanism.

Figure 14:
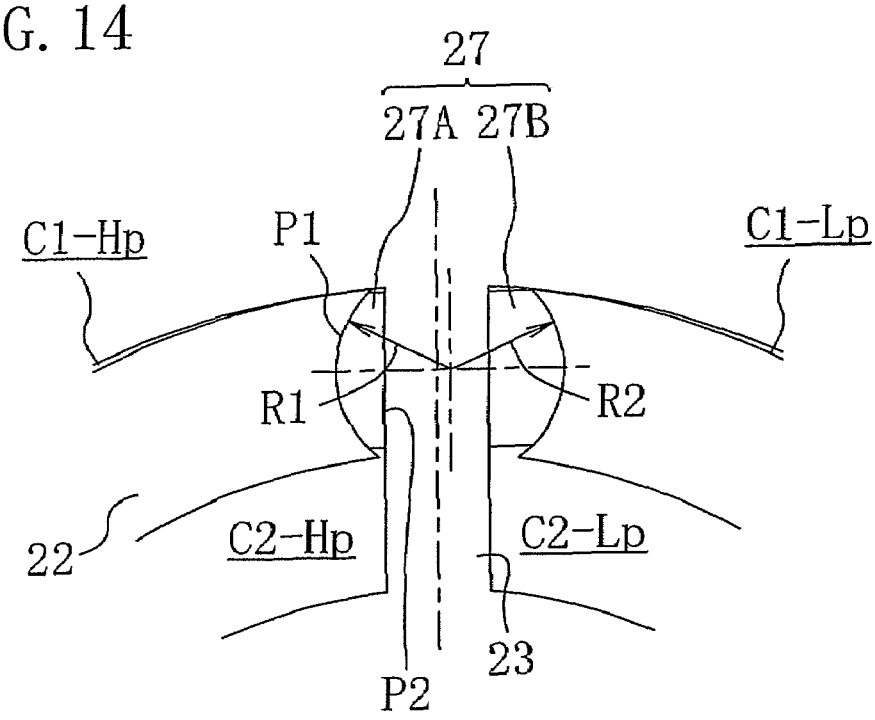
FIG. 14 is a configurational diagram which illustrates a variation of the swinging bush.
Figure 15:
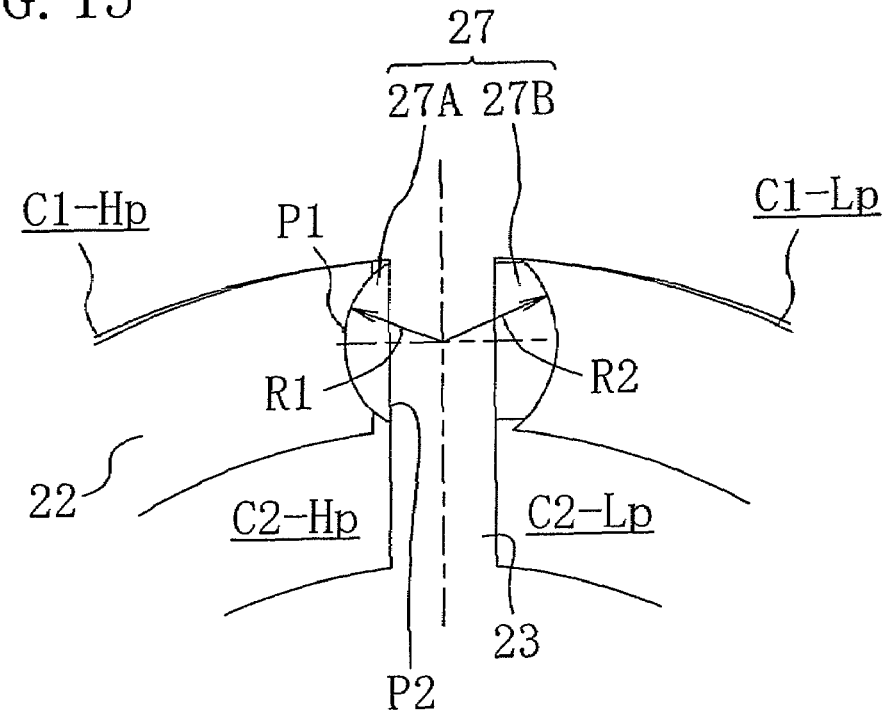
FIG. 15 is a configurational diagram which illustrates another variation of the swinging bush.
Figure 16:
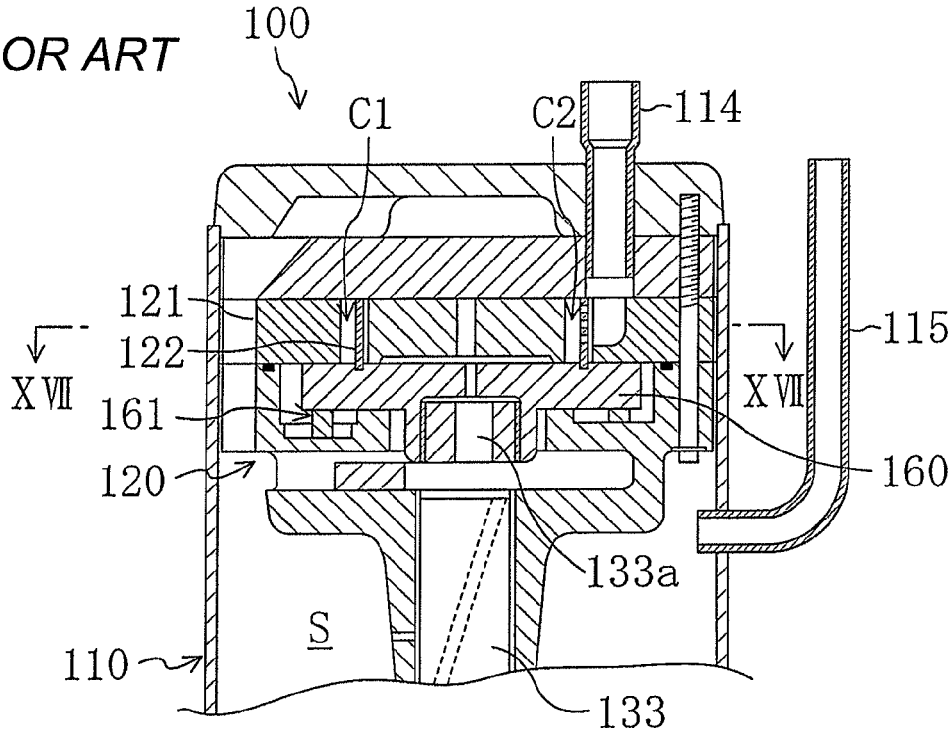
FIG. 16 PRIOR ART
FIG. 16 is a partial longitudinal cross sectional view of a rotary compressor according to the conventional technology.
Figure 17:
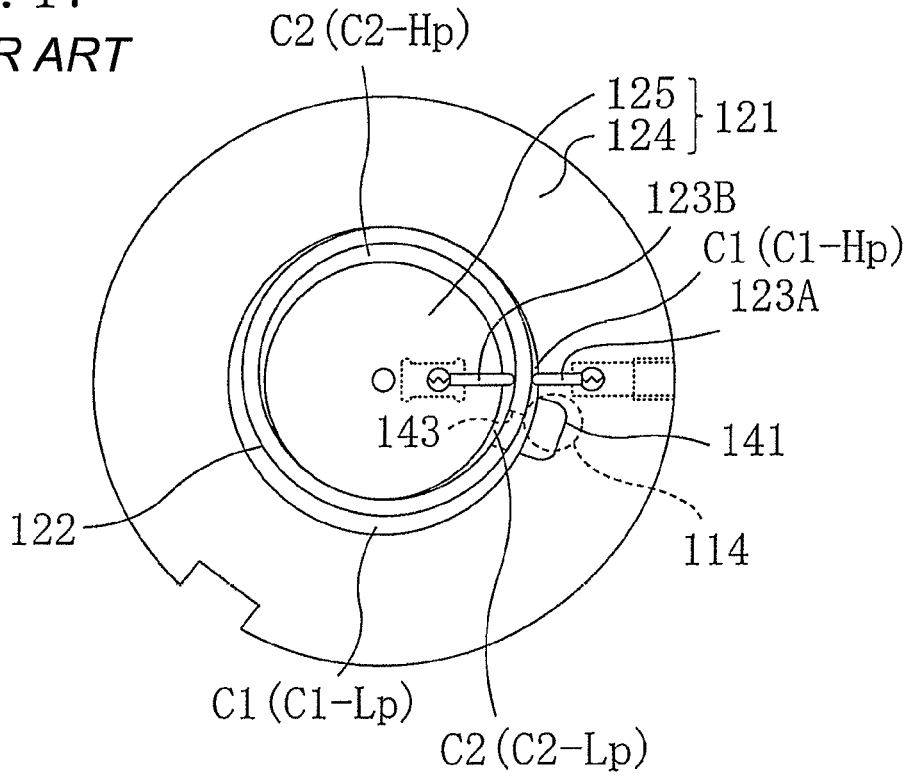
FIG. 17 PRIOR ART
FIG. 17 is a cross sectional view taken along line XVII-XVII of FIG. 16.
Figure 18:
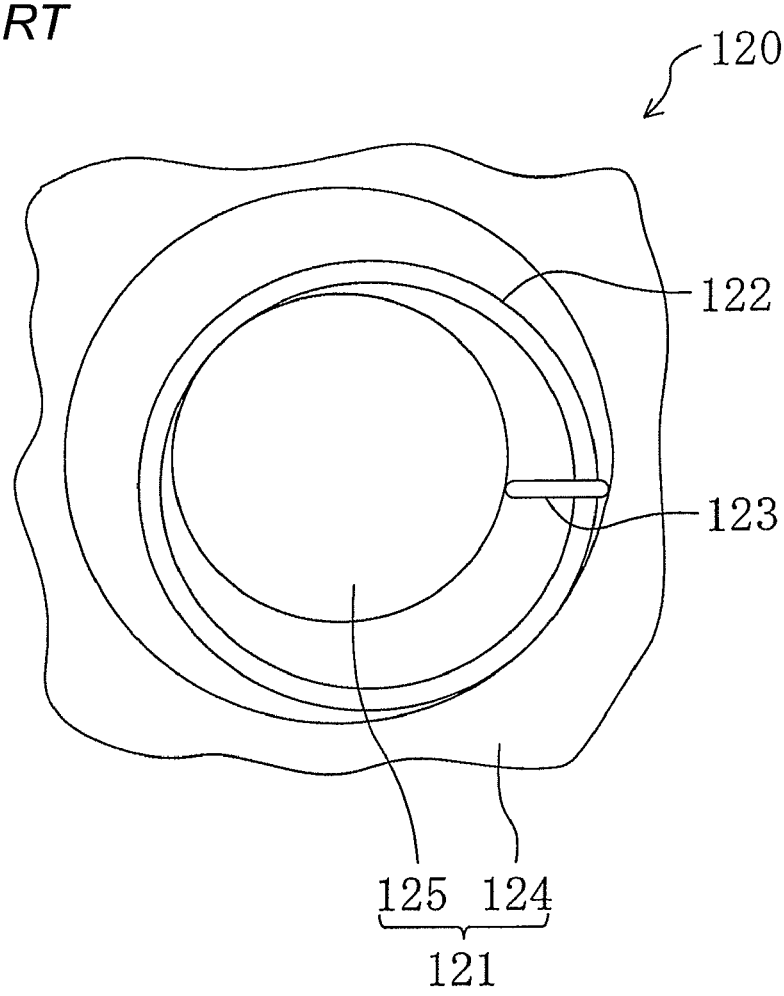
FIG. 18 PRIOR ART
FIG. 18 is a cross sectional view which illustrates a variation of FIG. 17.

In addition, the conventional technology shown in FIGS. 14 through 16 employs an Oldham mechanism as a rotation preventing mechanism for permitting the annular piston (22) to execute only an eccentric rotary motion while inhibiting the annular piston (22) from rotating. In the first embodiment, however, the coupling of the annular piston (22) and the blade (23) by the use of the swinging bush (27) itself constitutes an annular piston rotation preventing mechanism. Consequently, there is no need to provide a dedicated rotation preventing mechanism, thereby making it possible to provide compact design.

Variations of the First Embodiment

First Variation

Figure 3:
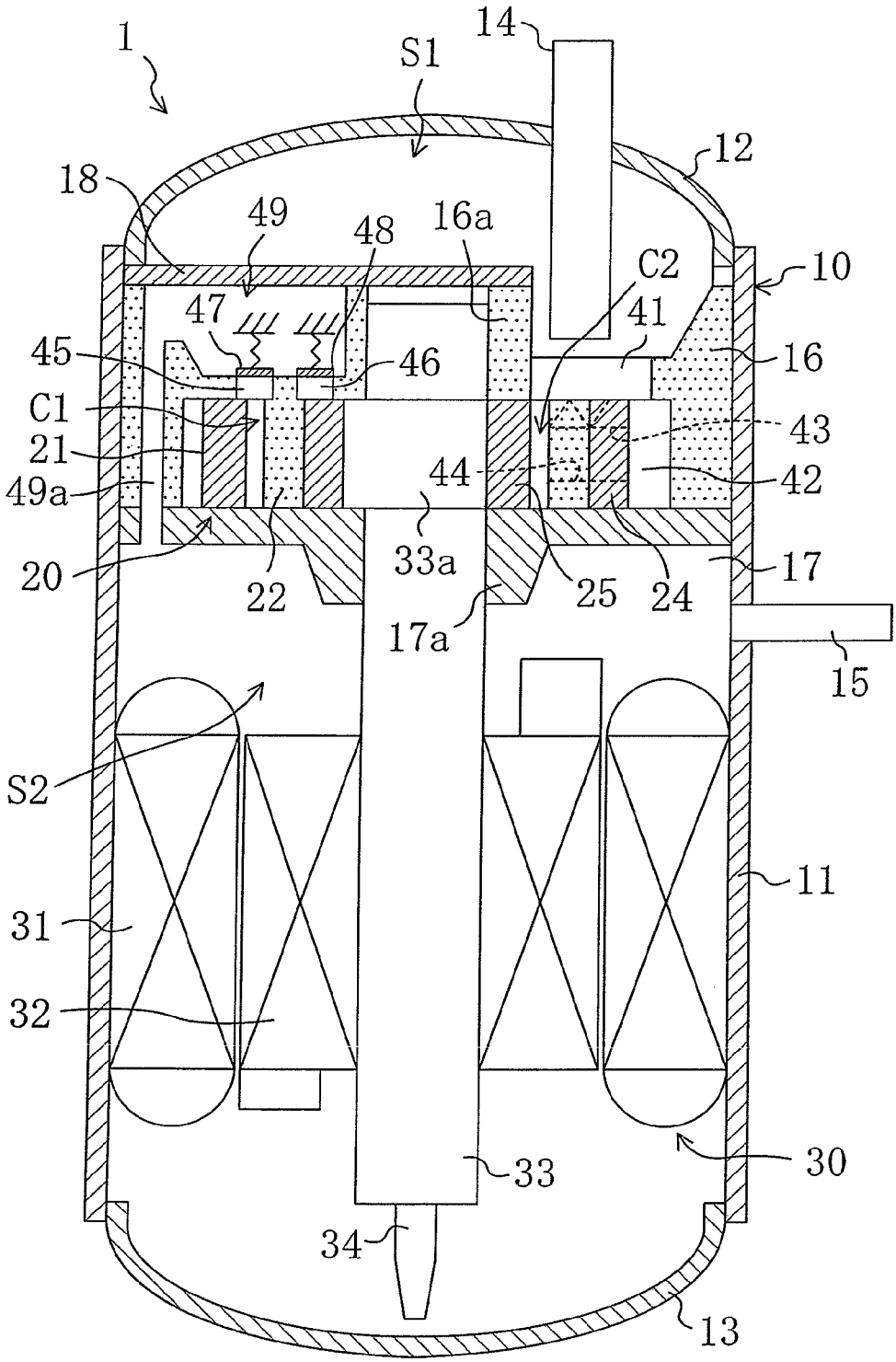
FIG. 3 is a longitudinal cross sectional view of a rotary compressor according to a first variation of the first embodiment.

With reference to FIG. 3, there is shown a first variation of the first embodiment.

In the first variation, the cylinder (21) is configured without using the end plate (26). More specifically, the cylinder (21) is formed by integration of the outer cylinder (24), the inner cylinder (25), and the blade (23). In addition, the seal ring (29) shown in FIG. 1 is not provided.

The above configuration further simplifies the configuration of the cylinder (21), thereby making it possible to downsize the compression mechanism (20).

Since the other configurations, operations, effects are the same as the first embodiment, their detailed description is omitted here.

Second Variation

In a second variation of the first embodiment, the diameter dimension (D) of the circular arc-like outer peripheral surface of the swinging bush (27) is made greater than the wall thickness dimension (T) of the annular piston (22). In this case, what is meant by the "wall thickness dimension of the annular piston (22)" is the difference between the radial dimension of the outer peripheral surface of the annular piston (22) and the radial dimension of the inner peripheral surface of the annular piston (22). More specifically, it is arranged such that the diameter dimension (D) of the circular arc-shaped outer peripheral surface of the swinging bush (27) is made greater than the diagonal dimension of a quadrangle defined by intersecting points of extensions of the inner and outer peripheral circles of the annular piston (22) with both sides of the blade (23).

Figure 4:
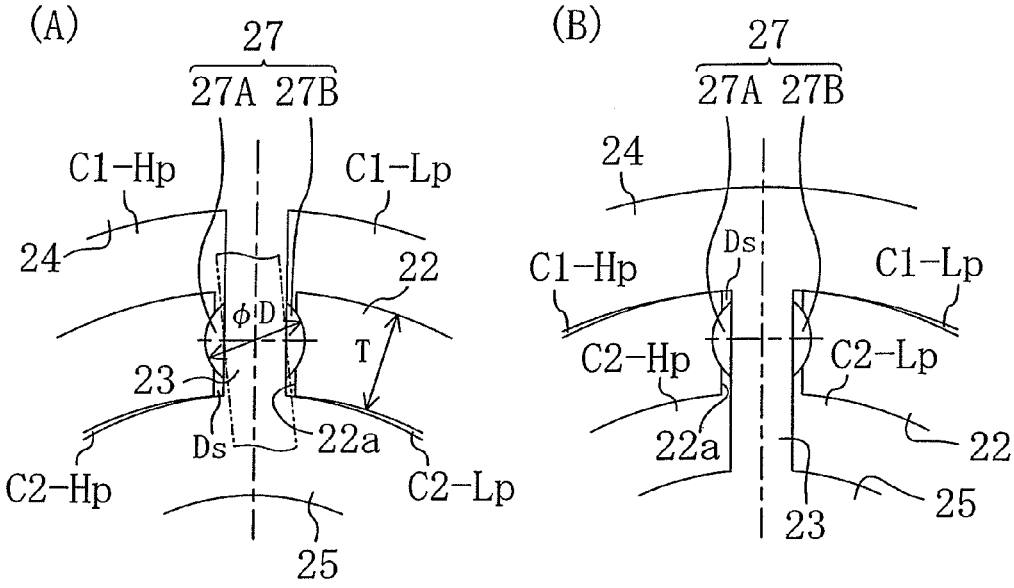
FIG. 4 is a configurational diagram of a comparative example of a swinging bush according to a second variation of the first embodiment.

Here, if the diameter dimension (D) of the swinging bush (27) equals the wall thickness dimension (T) of the annular piston (22), as shown in FIG. 4(A) which illustrates a comparative example when the annular piston (22) is in its lower dead point position and as shown in FIG. 4(B) which illustrates the comparative example when the annular piston (22) is in its upper dead point position, this requires the provision of a notched part (22*a*) in the annular piston (22) in order that the behavior of the blade (23) (see virtual line of FIG. 4(A)) may not be obstructed when the annular piston (22) executes an eccentric rotary motion. In this case, the space defined by the notched part (22*a*) becomes an invalid volume (Ds), in other words high pressure gas is not discharged therefrom but remains therein even after completion of a compression process in the high pressure chamber (C2-Hp). As a result, the high pressure gas lingering in the invalid volume (Ds) leaks into the low pressure chamber (C2-Lp) at the start of a subsequent suction process and is re-expanded, thereby deteriorating the efficiency.

Figure 5:
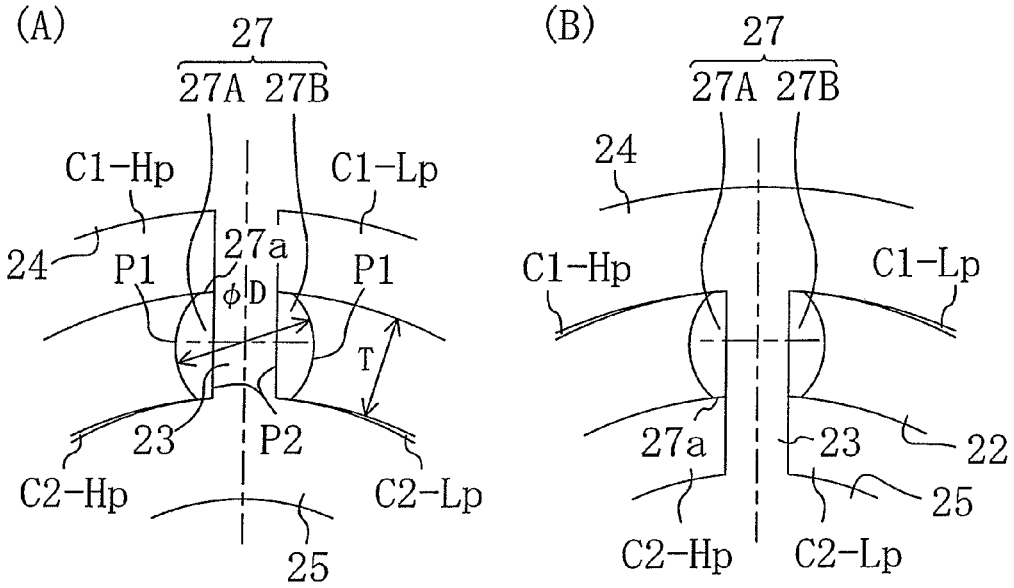
FIG. 5 is a configurational diagram of the swinging bush according to the second variation of the first embodiment.

On the other hand, in the present variation, as shown in FIG. 5(A) which depicts the annular piston (22) in its lower dead point position and as shown in FIG. 5(B) which depicts the annular piston (22) in its upper dead point position, the diameter dimension (D) of the swinging bush (27) is made to exceed the wall thickness dimension (T) of the annular piston (22) (in other words, the diameter dimension (D) of the swinging bush (27) is made greater than the diagonal dimension of a quadrangle defined by intersecting points of extensions of the inner and outer peripheral circles of the annular piston (22) with both sides of the blade (23)) so that the invalid volume (Ds) can be lessened just by the provision of a chamfered part (27*a*) in the annular piston (22). Accordingly, reexpansion loss reduction when the eccentric rotary piston mechanism (20) is implemented by a compression mechanism is accomplished, thereby making it possible to enhance the operating efficiency.

In the way as described above, in accordance with the second variation, the swinging bush (27) can be configured such that it becomes superior especially in the efficient aspect of the eccentric rotary piston mechanism (20), when the annular piston (22) and the blade (23) are coupled together by the swinging bush (27).

Third Variation

In a third variation of the first embodiment, the swing center of the swinging bush (27) is more radially inwardly displaced than the wall thickness center of the annular piston (22).

Figure 6:
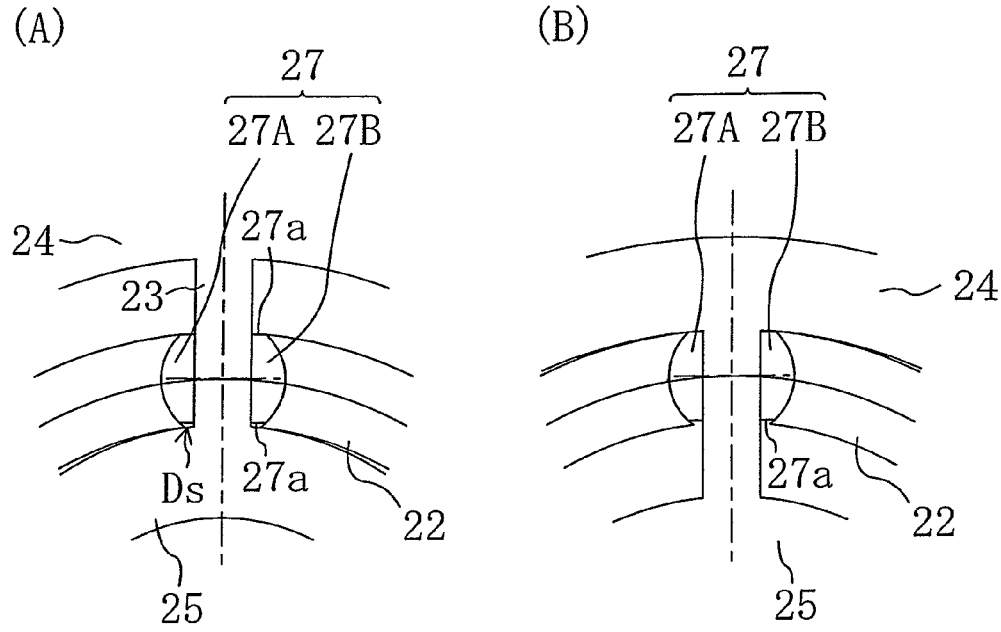
FIG. 6 is a configurational diagram of a comparative example of a swinging bush according to a third variation of the first embodiment.

Here, if the swinging bush (27) of the symmetrical type is employed whose center corresponds to the wall thickness center of the annular piston (22) and which has at its both sides identical chamfered parts (27*a*), as shown in FIG. 6(A) which shows an comparative example when the annular piston (22) is in its lower dead point position and as shown in FIG. 6(B) which shows the comparative example when the annular piston (22) is in its upper dead point position, this creates the invalid volume (Ds) inside the annular piston (22), and reexpansion loss becomes a problem. Conversely speaking, when it is attempted to accomplish a reexpansion loss reduction when the center of the swinging bush (27) is made to agree with the wall thickness center of the annular piston (22), this requires the provision of the swinging bush (27) of the asymmetric type in which only the chamfered part (27*a*) on the inside of the annular piston (22) is made small and whose assembly work is troublesome.

Figure 7:
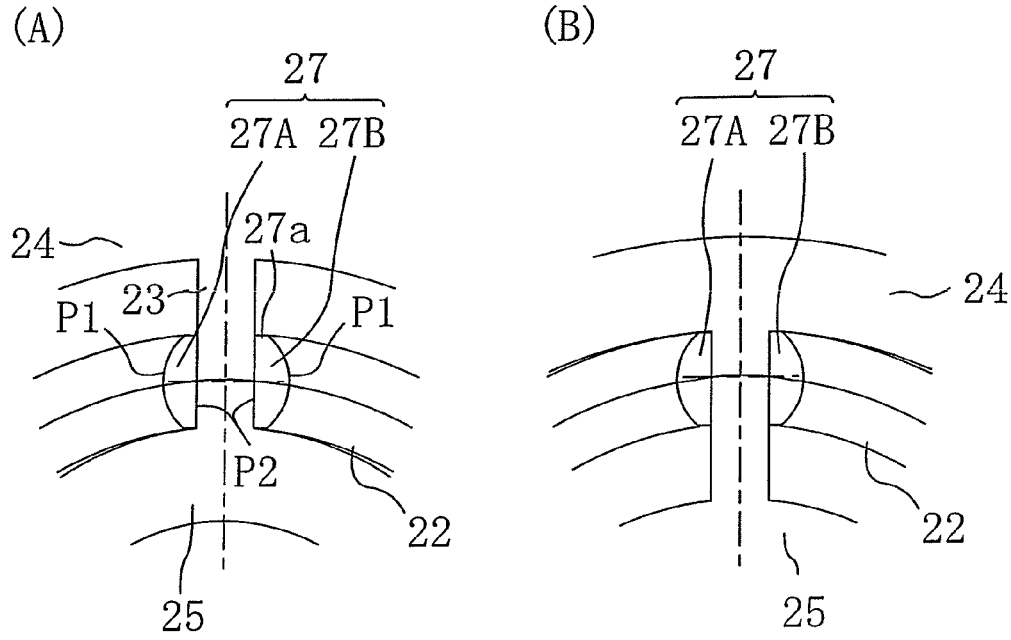
FIG. 7 is a configurational diagram of the swinging bush of the third variation of the first embodiment.

On the other hand, in the present variation, as shown in FIG. 7(A) which depicts the annular piston (22) in its lower dead point position and as shown in FIG. 7(B) which depicts the annular piston (22) in its upper dead point position, the center of the swinging bush (27) is displaced more radially inwardly than the wall thickness center of the annular piston (22). Therefore, it becomes possible that the invalid volume (Ds) is hardly created even when the swinging bush (27) of the symmetrical type is employed. Because of this, reexpansion loss reduction can be accomplished easily, thereby making it possible to enhance the operating efficiency.

In the way as described above, in accordance with the third variation, like the second variation, the swinging bush (27) can be configured such that it becomes superior especially in the efficient aspect of the eccentric rotary piston mechanism (20), when the annular piston (22) and the blade (23) are coupled together by the swinging bush (27).

In addition, even when, instead of employing the asymmetrical swinging bush (27), the symmetrical swinging bush (27) is used, it becomes possible to accomplish a reduction in the reexpansion loss, thereby making it possible to easily avoid the occurrence of a malassembly of the mechanism. In other words, when employing the swinging bush (27) having an asymmetrical shape, the mechanism may be misassembled because of making a mistake about the assembly direction. The present variation, since it employs the swinging bush (27) having a symmetrical shape, eliminates the occurrence of a malassembly and the need for complicated work operations for preventing the occurrence of a malassembly.

SECOND EMBODIMENT OF THE INVENTION

The present invention provides a second embodiment which is an exemplary embodiment in which the layout of the compression mechanism (20) and the electric motor (30) in the casing (10) differs from the first embodiment.

Figure 8:
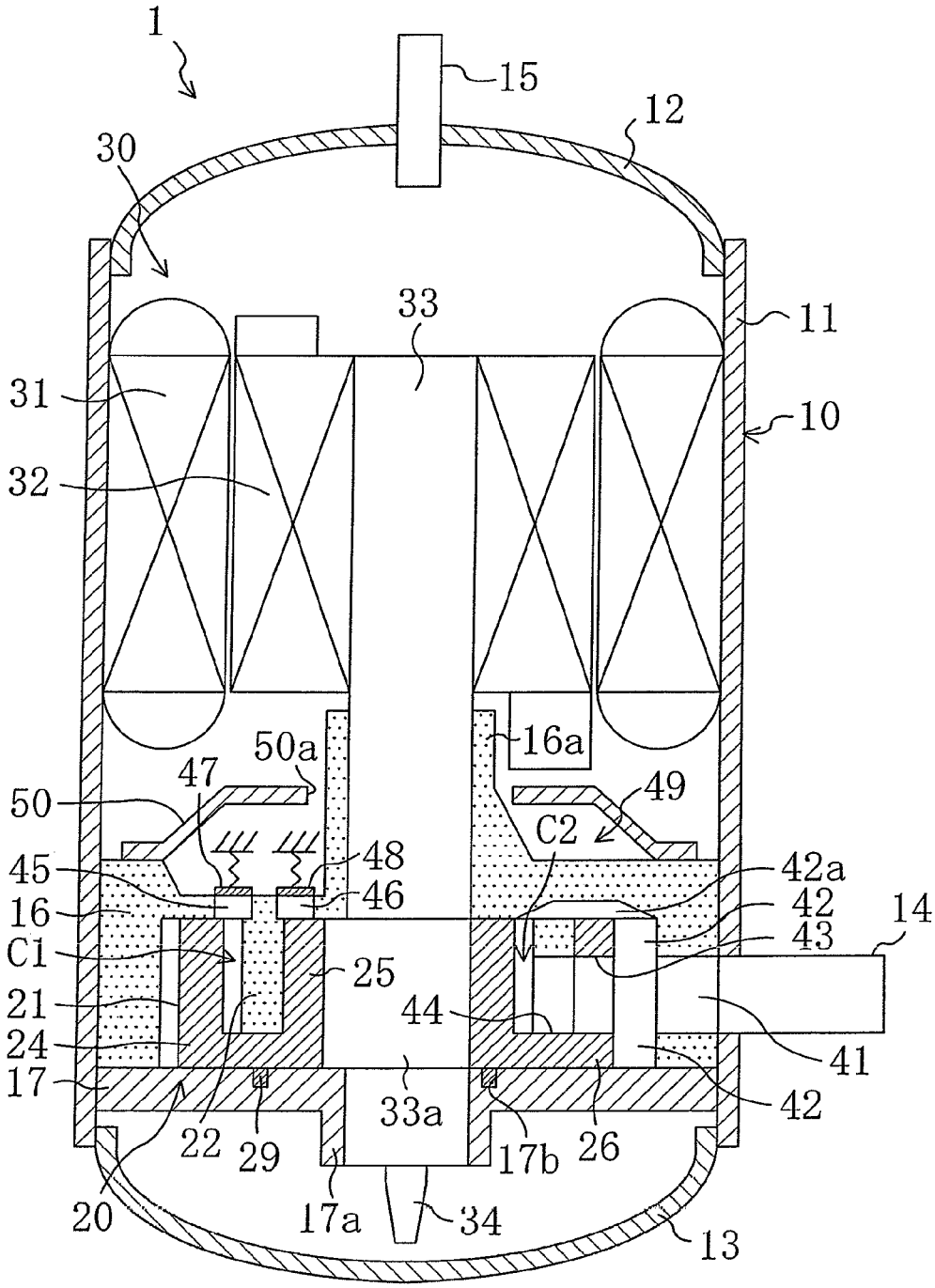
FIG. 8 is a longitudinal cross sectional view of a rotary compressor according to a second embodiment of the present invention.

In the second embodiment, as shown in FIG. 8, the compression mechanism (20) is disposed in a lower portion of the casing (10) while the electric motor (30) is disposed in an upper portion of the casing (10). The compression mechanism (20) is configured between the upper housing (16) and the lower housing (17) which are firmly fixed to the lower part of the casing (10), wherein the annular piston (22) is formed integrally with the upper housing (16). The cylinder (21) is formed by integrating the outer cylinder (24), the inner cylinder (25), and the end plate (26). The inner cylinder (25) is slidably fitted into the eccentric part (33*a*) of the driving shaft (33) and is held between the upper housing (16) and the lower housing (17). In addition, the upper housing (16) and the lower housing (17) are respectively provided with bearing parts (16*a*, 17*a*) for supporting the driving shaft (33).

The trunk part (11) of the casing (10) is provided with a suction pipe (14) and the upper end plate (12) is provided with a discharge pipe (15). In addition, in the upper housing (16), a suction space (42) and a suction passageway (42*a*) are formed, wherein the suction space (42) is in fluid communication with the suction pipe (14) through the suction opening (41), while the suction passageway (42*a*) is in fluid communication with the low pressure chamber (C1-Lp) of the outer cylinder chamber (C1) and the low pressure chamber (C2-Lp) of the inner cylinder chamber (C2) from the suction space (42). Furthermore, the suction space (42) is in fluid communication with the low pressure chamber (C1-Lp) of the outer cylinder chamber (C1) through the through-hole (43) of the outer cylinder (24) and is further in fluid communication with the low pressure chamber (C2-Lp) of the inner cylinder chamber (C2) through the through-hole (44) of the annular piston (22).

In the upper housing (16), a discharge opening (45) of the outer cylinder chamber (C1) and a discharge opening (46) of the inner cylinder chamber (C2) are formed, wherein the discharge opening (45) is provided with a discharge valve (47) while the discharge opening (46) is provided with a discharge valve (48).

The upper housing (16) is provided with a discharge cover (sound deadening member) with which the discharge openings (45, 46) are covered. Defined between the discharge cover (50) and the upper housing (16) is a discharge space (49). The discharge space (49) fluidly communicates, through an opening (50*a*) formed in the center of the discharge cover (50), with a space defined above the discharge cover (50).

The other configurations of the second embodiment are the same as the first embodiment. Accordingly, the description of the configurations other than the above is omitted here.

Also in the second embodiment, like the first embodiment, the swinging bush (27) is provided as a coupling member for coupling together the annular piston (22) and the blade (23) and it is configured such that the swinging bush (27) substantially comes into surface contact, at the sliding surfaces (P1, P2), with the annular piston (22) and the blade (23). This therefore prevents the annular piston (22) and the blade (23) from wearing and further prevents their contact parts from undergoing seizure during the operation.

In addition, since the swinging bush (27) comes into surface contact with the annular piston (22) and the blade (23), the sealability of the contact parts is excellent, which is also the same as the first embodiment. This therefore prevents the occurrence of a drop in the compression efficiency due to refrigerant leakage into the low pressure chamber (C1-Lp, C2-Lp) from the high pressure chamber (C1-Hp, C2-Hp) in each of the outer cylinder chamber (C1) and the inner cylinder chamber (C2).

The same advantageous effects that the first embodiment accomplishes are obtained. More specifically, other than the above-described advantageous effects, the present embodiment provides, in addition to vibration and noise reduction owing to total torque curve amplitude reduction and cost reduction, further advantageous effects such as simplified configuration when compared to the conventional 2-cylinder type, liquid-compression prevention et cetera.

Additionally, in the present embodiment, the compression mechanism (20) is disposed in the lower part of the casing (10) so that the sliding parts of mechanism are situated in the vicinity of the lubricant sump. This provides a benefit of facilitating lubrication.

THIRD EMBODIMENT OF THE INVENTION

The present invention provides a third embodiment which is an exemplary embodiment in which a part of the configuration of the compression mechanism (20) of the first embodiment is modified.

Figure 9:
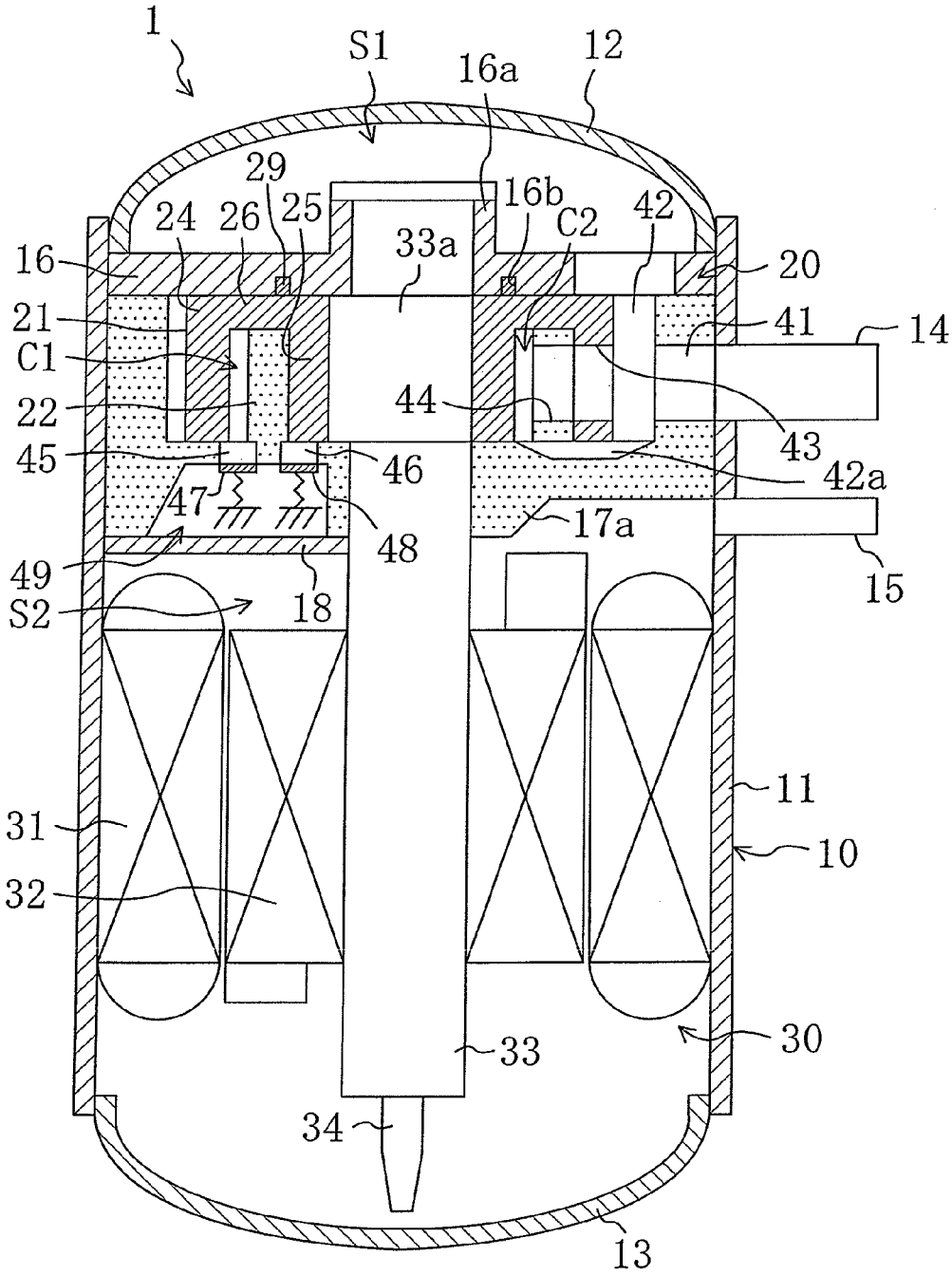
FIG. 9 is a longitudinal cross sectional view of a rotary compressor according to a third embodiment of the present invention.

In the third embodiment, as shown in FIG. 9, the compression mechanism (20) itself is configured upside down in comparison to the first embodiment and, in addition, the suction configuration is modified. More specifically, the cylinder (21) is integrally configured by coupling together the outer cylinder (24) and the inner cylinder (25) with the end plate (26) at its upper end. In addition, the annular piston (22) is formed integrally with the lower housing (17). The seal ring (29) is mounted in an annular groove (16*b*) formed in the upper housing (16) and is brought into pressure contact with the upper surface of the end plate (26) of the cylinder (21).

The suction pipe (14) is laterally mounted to the trunk part (11) of the casing (10) and a suction opening (41) in fluid communication with the suction pipe (14) is formed in the lower housing (17). In addition, in the lower housing (17), a suction space (42) and a suction passageway (42*a*) are formed, wherein the suction space (42) fluidly communicates with the suction opening (41) while the suction passageway (42*a*) fluidly communicates with the low pressure chamber (C1-Lp) of the outer cylinder chamber (C1) and the low pressure chamber (C2-Lp) of the inner cylinder chamber (C2) from the suction space (42). The suction space (42) is in fluid communication, through the through-hole (43) of the outer cylinder (24), with the low pressure chamber (C1-Lp) of the outer cylinder chamber (C1), and is also in fluid communication, through the through-hole (44) of the annular piston (22), with the low pressure chamber (C2-Lp) of the inner cylinder chamber (C2).

Discharge openings (45, 46) are formed in the lower housing (17). The discharge opening (45) of the outer cylinder chamber (C1) is provided with a discharge valve (47) and the discharge opening (46) of the inner cylinder chamber (C2) is provided with a discharge valve (48). In addition, the lower housing (17) is provided, at its lower surface, a cover plate (18), and there is defined a discharge space (49) between the lower housing (17) and the cover plate (18). The discharge space (49) fluidly communicates through a discharge passageway (not shown) with the high pressure space (S2) below the compression mechanism (20).

The other configurations of the present embodiment are the same as the first embodiment.

Also in the third embodiment, as a coupling member for coupling together the annular piston (22) and the blade (23), the swinging bush (27) is provided, and it is configured such that the swinging bush (27) substantially comes into surface contact, at the sliding surfaces (P1, P2), with the annular piston (22) and the blade (23), as in each of the foregoing embodiments. This therefore prevents the annular piston (22) and the blade (23) from wearing and further prevents their contact parts from undergoing seizure during the operation.

In addition, since the swinging bush (27) comes into surface contact with the annular piston (22) and the blade (23), the sealability of the contact parts is also excellent, which is also the same as each of the foregoing embodiments. This therefore prevents the occurrence of a drop in compression efficiency due to refrigerant leakage to the low pressure chamber (C1-Lp, C2-Lp) from the high pressure chamber (C1-Hp, C2-Hp) in each of the outer cylinder chamber (C1) and the inner cylinder chamber (C2).

Furthermore, the same advantageous effects that each of the aforesaid embodiments accomplishes are obtained. More specifically, other than the above-described advantageous effects, the present embodiment provides, in addition to vibration and noise reduction owing to total torque curve amplitude reduction and cost reduction, further advantageous effects such as simplified configuration when compared to the conventional 2-cylinder type, liquid-compression prevention et cetera.

FOURTH EMBODIMENT OF THE INVENTION

The present invention provides a fourth embodiment which is an exemplary embodiment in which, contrary to each of the first to third embodiments in which the annular piston (22) is a stationary side and the cylinder (21) is a movable side, the cylinder (21) is a stationary side and the annular piston (22) is a movable side.

Figure 10:
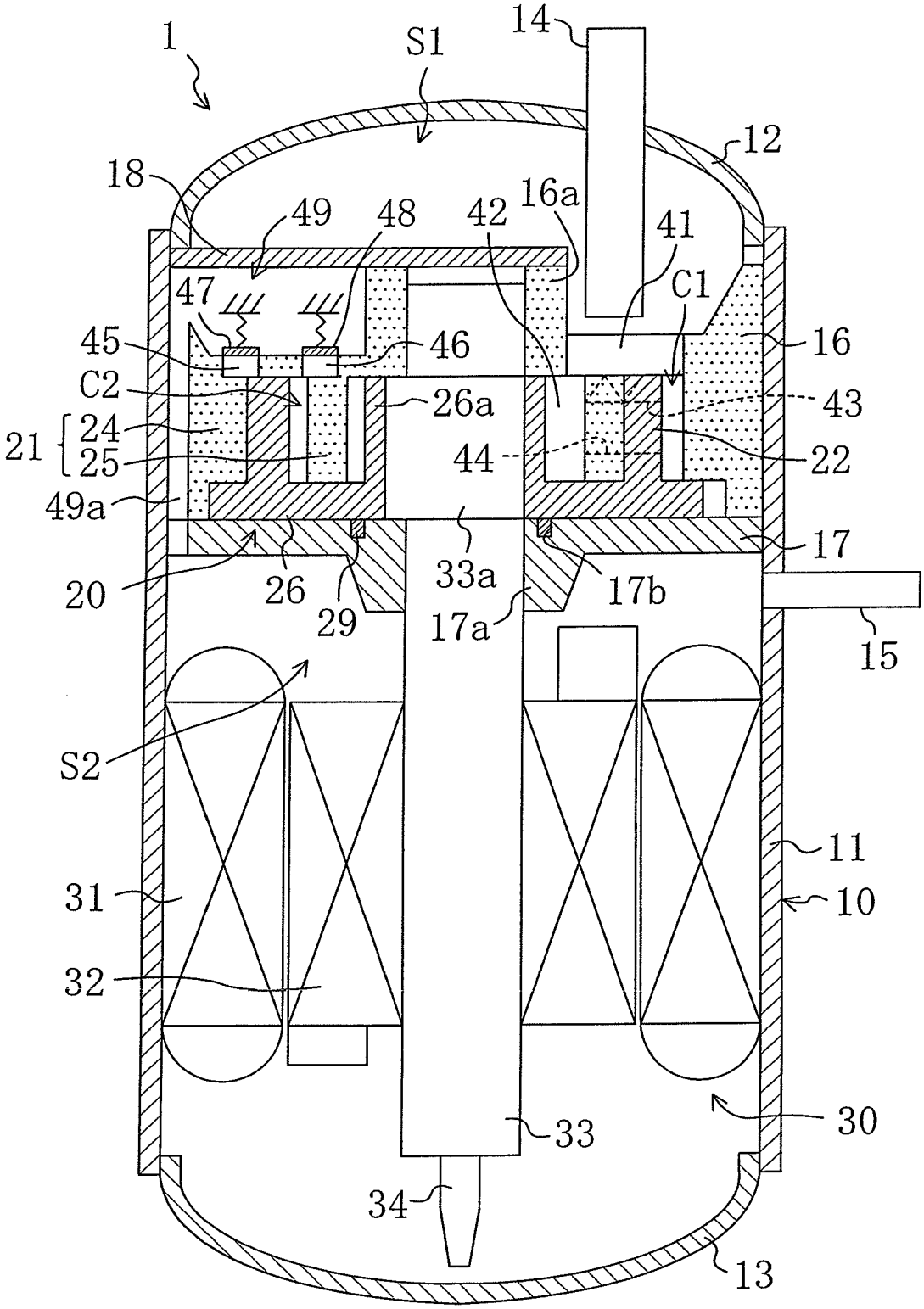
FIG. 10 is a longitudinal cross sectional view of a rotary compressor according to a fourth embodiment of the present invention.

In the fourth embodiment, as shown in FIG. 10, the compression mechanism (20) is disposed in the upper part of the casing (10), as in the first embodiment. Like each of the foregoing embodiments, the compression mechanism (20) is configured between the upper housing (16) and the lower housing (17).

On the other hand, unlike each of the foregoing embodiments, the upper housing (16) is provided with the outer cylinder (24) and the inner cylinder (25). The outer cylinder (24) and the inner cylinder (25) are made integral with the upper housing (16) to form the cylinder (21).

The annular piston (22) is held between the upper housing (16) and the lower housing (17). The annular piston (22) is made integral with the end plate (26). The end plate (26) is provided with a hub (26*a*) which is slidably fitted into the eccentric part (33*a*) of the driving shaft (33). Accordingly, in this configuration, when the driving shaft (33) rotates, the annular piston (22) executes an eccentric rotary motion within the cylinder chamber (C1, C2). In addition, the blade (23) is made integral with the cylinder (21), as in each of the foregoing embodiments.

In the upper housing (16), a suction opening (41) which fluidly communicates with the outer and inner cylinder chambers (C1, C2) from the low pressure space (S1) above the compression mechanism (20) of the casing (10), a discharge opening (45) of the outer cylinder chamber (C1), and a discharge opening (46) of the inner cylinder (25) are formed. In addition, a suction space (42) in fluid communication with the suction opening (41) is formed between the hub (26*a*) and the inner cylinder (25); a through-hole (44) is formed in the inner cylinder (25); and a through-hole (43) is formed in the annular piston (22). Furthermore, it is desirable that the upper end of each of the annular piston (22) and the inner cylinder (25) is chamfered at a place corresponding to the suction opening (41) as indicated by broken line.

Mounted above the compression mechanism (20) is a cover plate (18). There is defined a discharge space (49) between the upper housing (16) and the cover plate (18). This discharge space communicates through a discharge passageway (49*a*) formed through the upper and lower housings (16, 17) with the high pressure space (S2) underlying the compression mechanism (20).

Also in the fourth embodiment, as a coupling member for coupling together the annular piston (22) and the blade (23), the swinging bush (27) is provided, and it is configured such that the swinging bush (27) substantially comes into surface contact, at the sliding surfaces (P1, P2), with the annular piston (22) and the blade (23), as in each of the foregoing embodiments. This therefore prevents the annular piston (22) and the blade (23) from wearing and further prevents their contact parts from undergoing seizure during the operation.

In addition, since the swinging bush (27) comes into surface contact with the annular piston (22) and the blade (23), the sealability of the contact parts is excellent, which is also the same as each of the foregoing embodiments. This therefore prevents the occurrence of a drop in the compression efficiency due to refrigerant leakage into the low pressure chamber (C1-Lp, C2-Lp) from the high pressure chamber (C1-Hp, C2-Hp) in the each of the outer cylinder chamber (C1) and the inner cylinder chamber (C2).

Furthermore, the same advantageous effects that each of the aforesaid embodiments accomplishes are obtained. More specifically, other than the above-described advantageous effects, the present embodiment provides, in addition to vibration and noise reduction owing to total torque curve amplitude reduction and cost reduction, further advantageous effects such as simplified configuration when compared to the conventional 2-cylinder type, liquid-compression prevention et cetera.

FIFTH EMBODIMENT OF THE INVENTION

The present invention provides a fifth embodiment which is an exemplary embodiment in which there is made a difference in suction shutoff angle between the outer cylinder chamber (C1) formed on the outside of the annular piston (22) and the inner cylinder chamber (C2) formed on the inside of the annular piston (22).

The fifth embodiment employs a suction structure as already described herein with reference to FIGS. 8 and 9. This suction structure allows refrigerant to be drawn, through the through-hole (43) of the outer cylinder (24) and the through-hole (44) of the inner cylinder (25), into the outer and inner cylinder chambers (C1, C2) from the suction pipe (14) laterally mounted to the trunk part (11) of the casing (10) and the suction space (42).

Figure 11:
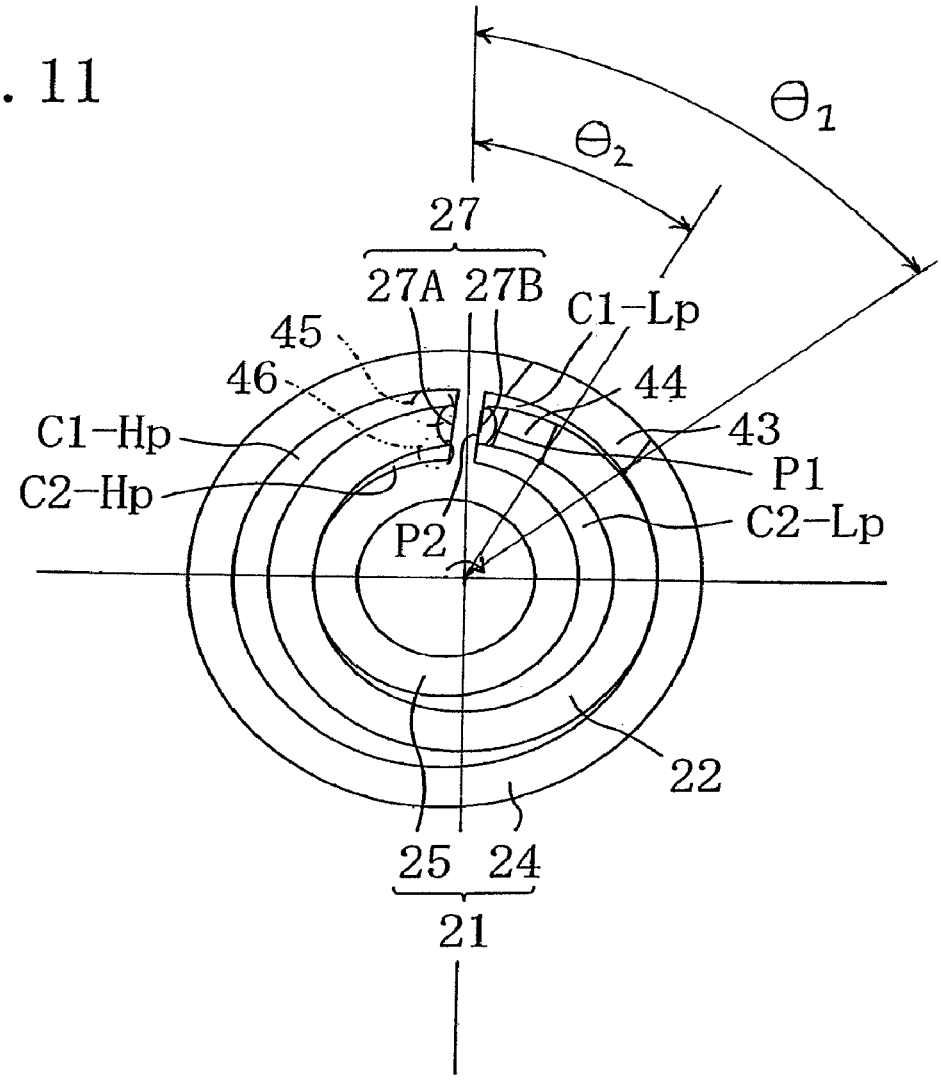
FIG. 11 is a transverse cross sectional view which illustrates a compression mechanism of a rotary compressor according to a fifth embodiment of the present invention.

As shown in FIG. 11, the through-hole (43) of the outer cylinder (24) is so formed as to be circumferentially greater in length than the through-hole (44) of the piston (22). As a result of such arrangement, the position in which the suction process is completed (i.e., the position in which the compression process is commenced) in the outer cylinder chamber is made to be reached later than in the inner cylinder chamber (C2). In other words, the suction shutoff angle ($\theta_1$) of the outer cylinder chamber (C1) exceeds the suction shutoff angle ($\theta_2$) of the inner cylinder chamber (C2), as shown in FIG. 11.

As a result of the above configuration, the compression volume of the outer cylinder chamber (C1) can be made less than the compression volume of the outer cylinder chamber (C1) in each of the foregoing embodiments. As a result, it becomes possible to reduce the difference between the compression volume of the outer cylinder chamber (C1) situated on the outside of the annular piston (22) and the compression volume of the inner cylinder chamber (C2) situated on the inside of the annular piston (22). This therefore reduces the difference between the amplitude of torque fluctuations associated with the compression operation in the outer cylinder chamber (C1) and the amplitude of torque fluctuations associated with the compression operation in the inner cylinder chamber (C2), thereby making it possible to further reduce the overall torque fluctuation in comparison with each of the foregoing embodiments. This therefore makes it possible to enhance vibration lowering merit and noise lowering merit.

In addition, other than the above, the same advantageous effects that each of the foregoing embodiments accomplishes are obtained.

SIXTH EMBODIMENT OF THE INVENTION

The present invention provides a sixth embodiment which is an exemplary embodiment in which a heat insulating space (S3) is formed around the outer periphery of the compression mechanism (20).

Figure 12:
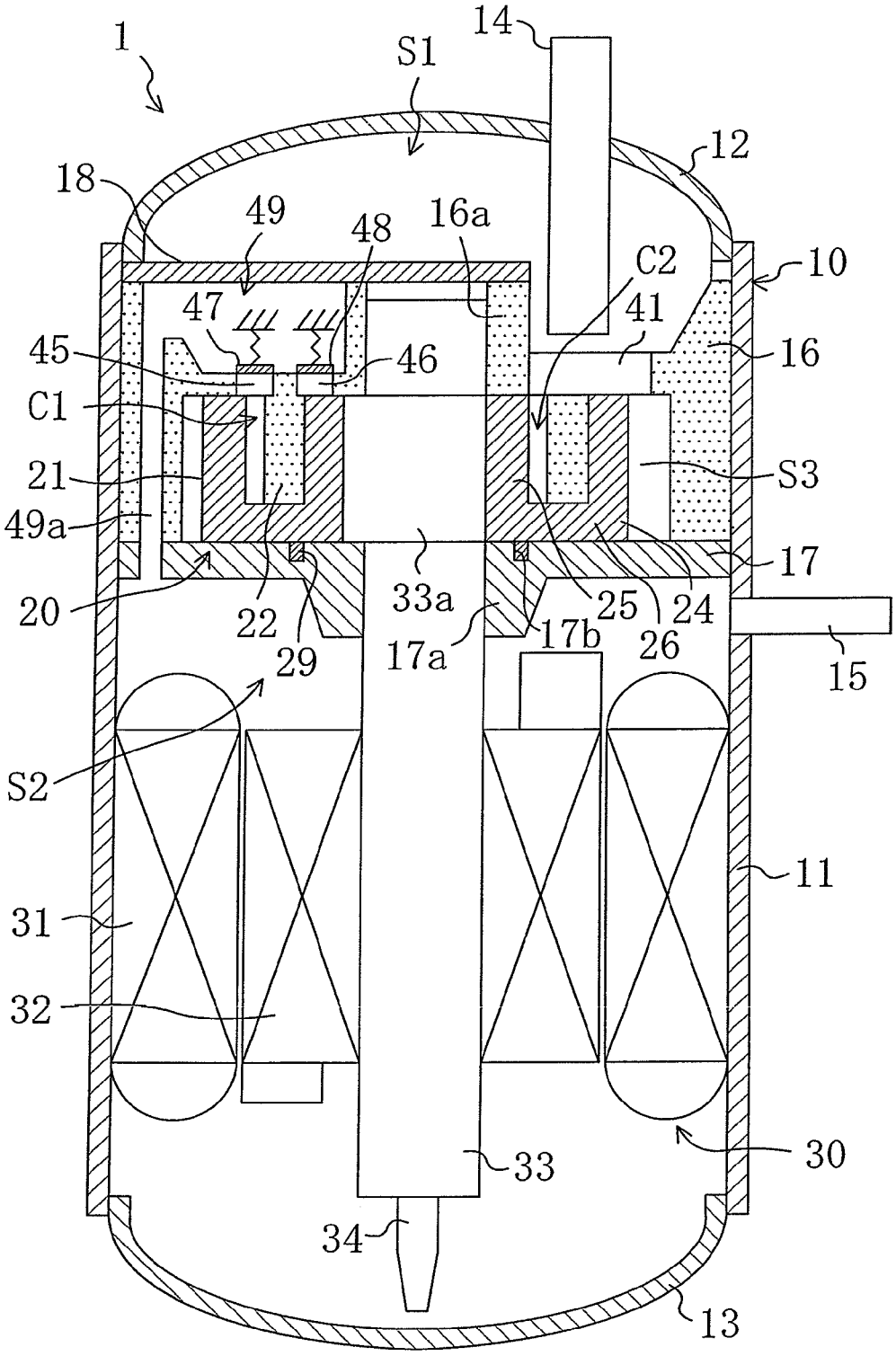
FIG. 12 is a longitudinal cross sectional view of a rotary compressor according to a sixth embodiment of the present invention.

More specifically, as shown in FIG. 12, the through-hole (43) of the outer cylinder (24) and the through-hole (44) of the annular piston (22) which are formed in the first embodiment (FIG. 1) are not provided. Instead, the space around the outer cylinder (24) serves as the heat insulating space (S3) of low pressure. Stated another way, in the sixth embodiment, the suction space (42) of the first embodiment functions as the heat insulating space (S3) in which low pressure refrigerant is accumulated.

The other configurations are the same as the first embodiment.

The above arrangement impedes the transfer of heat from the high pressure space (S2) to low pressure refrigerant which is drawn into the compression mechanism (20). Thus, the capacity degradation due to suction superheat loss is prevented.

SEVENTH EMBODIMENT OF THE INVENTION

Figure 13:
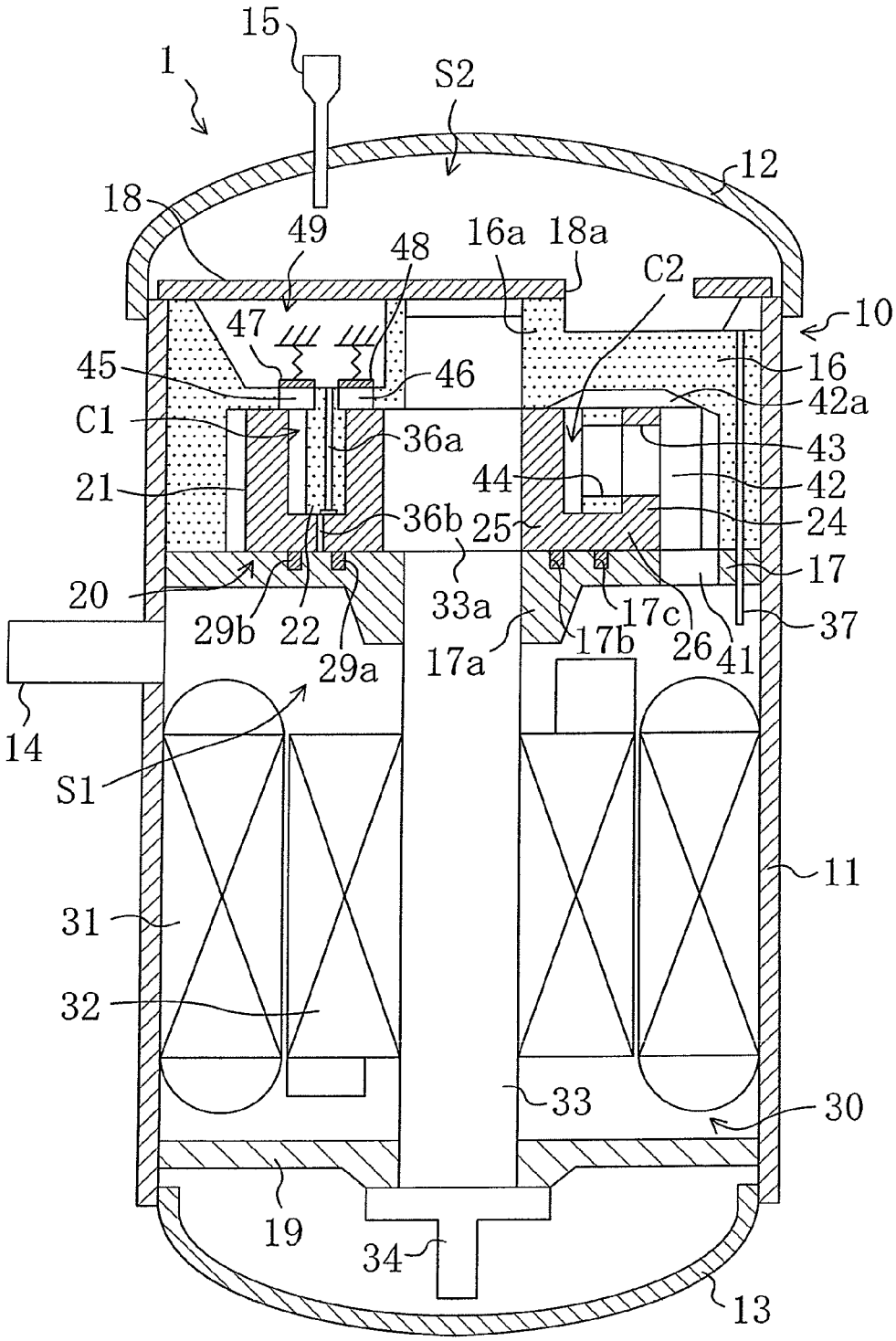
FIG. 13 is a longitudinal cross sectional view of a rotary compressor according to a seventh embodiment of the present invention.

The present invention provides a seventh embodiment which is an exemplary embodiment in which, as shown in FIG. 13, the space underneath the compression mechanism (20) in the casing (10) serves as the low pressure space (S1) and the space above the compression mechanism (20) serves as the high pressure space (S2). Hereinafter, the difference between the first embodiment and the present embodiment is mainly described.

In the compressor (1), the suction pipe (14) is provided in the trunk part (11) of the casing (11). The suction pipe (14) is extended completely through the trunk part (11). The discharge pipe (15) is provided in the upper end plate (12). The discharge pipe (15) is extended completely through the end plate (12).

In addition, the driving shaft (33) is supported, at its lower end, by a bearing member (19).

In regard to the compression mechanism (20), its suction configuration, discharge configuration, and compliance mechanism differ from the first embodiment.

In the first place, the lower housing (17) is provided with a suction opening (41) which is opened to the space (i.e., the low pressure space (S1)) below the compression mechanism (20). In addition, the upper housing (16) is provided with a suction space (42) and a suction passageway (42*a*). The suction space (42) fluidly communicates with the suction opening (41) and the suction passageway (42*a*) fluidly communicates with the low pressure chamber (C1-Lp) of the outer cylinder chamber (C1) and the low pressure chamber (C2-Lp) of the inner cylinder chamber (C2) from the suction space (42). The arrangement that the through-hole (43) for establishing fluid communication between the suction space (42) and the low pressure chamber (C1-Lp) of the outer cylinder chamber (C1) is formed in the outer cylinder (24) and the arrangement that the through-hole (44) for establishing fluid communication between the low pressure chamber (C1-Lp) of the outer cylinder chamber (C1) and the low pressure chamber (C2-Lp) of the inner cylinder chamber (C2) is formed in the annular piston (22) are the same as the first embodiment.

In addition, like the first embodiment, the upper housing (16) is provided with discharge openings (45, 46). Each of the discharge openings (45, 46) is extended completely through the upper housing (16) in an axial direction thereof. The lower end of the discharge opening (45) is opened such that it faces towards the high pressure chamber (C1-Hp) of the outer cylinder chamber (C1) while the lower end of the discharge opening (46) is opened such that it faces towards the high pressure chamber (C2-Hp) of the inner cylinder chamber (C2). On the other hand, the upper ends of the discharge openings (45, 46) fluidly communicate, respectively, through discharge valves (reed valves) (47, 48) for opening and closing the discharge valves (45, 46) with the discharge space (49).

The discharge space (49) is formed between the upper housing (16) and the cover plate (18). The discharge space (49) is a space which circumferentially continuously extends above the compression mechanism (20), and fluidly communicates through an opening (18*a*) of the cover plate (18) with the high pressure space (S2) overlying the cover plate (18). The discharge pipe (15) is opened at its lower end to the high pressure space (S2).

A piston side high pressure introducing passageway (36*a*) is formed in the annular piston (22) such that it is extended completely through from the upper end surface to the lower end surface of the annular piston (22). A cylinder side high pressure introducing passageway (36*b*) is formed in the end plate (26) of the cylinder (21) such that it is extended completely through from the upper end surface to the lower end surface of the end plate (26). The piston side high pressure introducing passageway (36*a*) and the cylinder side high pressure introducing passageway (36*b*) fluidly communicate with each other even during the operation of the compression mechanism (20) because of the arrangement that the lower end of the piston side high pressure introducing passageway (36) has a greater diameter, and high pressure in the discharge chamber (49) is introduced to the contact surface between the lower housing (17) and the end plate (26).

The lower housing (17) is provided with an inner seal ring (29*a*) which is positioned radially inwardly of the cylinder side high pressure introducing passageway (36*b*) and an outer seal ring (29*b*) which is positioned radially outwardly of the cylinder side high pressure introducing passageway (36*b*). These seal rings (29*a*, 29*b*) are mounted in the annular grooves (17*b*, 17*c*) of the lower housing (17). This constitutes, by making utilization of pressure between the seal rings (29*a*, 29*b*), a compliance mechanism operable to reduce an axial gap possibly created between the cylinder (21) and the annular piston (22).

On the other hand, an oil return pipe (oil return passageway) (37) is so formed as to extend vertically entirely through the upper and lower housings (16, 17). The oil return pipe (37) is formed by a capillary tube. Although discharge gas expelled from the compression mechanism (20) contains therein lubricant, the lubricant is separated from the refrigerant in the high pressure space (S1) and is accumulated on the upper surface of the upper housing (16). Then, the lubricant is returned back to the bottom part of the casing (10) by way of the oil return pipe (37) by the differential pressure between the high pressure space (S2) and the low pressure space (S1).

In the present embodiment, the refrigerant drawn into the low pressure space (S1) of the casing (10) from the suction pipe (14) is branched, after passage through the suction opening (41) and then through the suction space (42), into a route passing through the suction passageway (42*a*) and another route passing through the through-holes (43, 44), thereafter being drawn into the cylinder chamber (C1, C2). The refrigerant is compressed in the compression mechanism (20). Thereafter, the refrigerant flows out to the high pressure chamber (S2) from the discharge space (49), by way of the opening (18*a*) of the cover plate (18).

The high pressure refrigerant, after compression in the compression mechanism (20) and flowing out to the high pressure space (S2) in the way as described above, is discharged to outside the casing (10) from the discharge pipe (15) and, after subjected to a condensation process, an expansion process, and an evaporation process in the refrigerant circuit, is again drawn into the compressor (1). Lubricant contained in the refrigerant discharged from the compression mechanism (20) is separated from the refrigerant in the high pressure space (S2), is passed through the oil return pipe (37), falls in drops down to the low pressure space (S1), and is returned back to the lubricant sump in the lower part of the casing (10).

In the present embodiment, the space below the compression mechanism (20) serves as the low pressure space (S1) and the electric motor (30) is disposed in the low pressure space (S1), thereby making it possible to efficiently cool the electric motor (30) with low pressure gas. Accordingly, even when the volume of the compressor (1) is made large, it is possible to inhibit the electric motor (30) from undergoing capacity degradation, and the operating efficiency is enhanced.

In addition, discharge gas from the compression mechanism (20) flows into the high pressure space (S2) and is discharged from the discharge pipe (15), thereby making it possible to separate lubricant contained in the discharge gas in the high pressure space (S2). Besides, the lubricant is returned back to the lubricant sump of the casing (10) by way of the oil return pipe (37). This therefore prevents an increase in the circulation amount of lubricant in the refrigerant circuit. Conversely speaking, it becomes possible to prevent lack of lubricant in the compressor (1). In addition, there is no need to provide a dedicated oil separator for preventing the occurrence of lack of lubricant in the compressor (1).

Furthermore, the two spaces are formed across the compression mechanism (20) in the casing (10), wherein one of the two spaces serves as the low pressure space (S1) and the other space serves as the high pressure space (S2). This therefore makes it possible to provide the low and high pressure spaces (S1, S2) of simple configuration. This therefore prevents the configuration of the compressor (1) from becoming complicated and also prevents the compressor (1) from increasing in size.

In addition, since the low pressure space (S1) is formed below the compression mechanism (20) and the high pressure space (S2) is formed above the compression mechanism (20), this prevents the occurrence of liquid compression from taking place because liquid refrigerant is not drawn into the compression mechanism (20) even when liquid back is caused by a change in the operating condition of the refrigerant circuit.

Stated another way, in accordance with the configuration of the present embodiment, refrigerant is once introduced into the low pressure space (S1) when liquid back into the compressor (1) from the evaporator of the refrigerant circuit takes place due to a change in the operating condition. The refrigerant is separated into liquid and gas in the low pressure space (S1) and only gas is allowed to be drawn into the cylinder chambers (C1, C2). This makes it possible to allow the compressor (1) to function as an accumulator, thereby eliminating the need to provide a separate accumulator as a constitutional element of the refrigerant circuit.

OTHER EMBODIMENTS

In regard to the foregoing embodiments, the present invention may be configured as follows.

For example, the swinging bushes (27A, 27B) may be configured as shown in FIG. 14. In the example of FIG. 14, the discharge side bush (27A) and the suction side bush (27B) are formed into different shapes, in other words they have different width dimensions. More specifically, with respect to the center of the blade (23), the center of the circular arc-shaped outer peripheral surface of each of the discharge side bush (27A) and the suction side bush (27B) is deviated to the suction side (the radius (R1) of the circular arc-shaped outer peripheral surface of the discharge side bush (27A) and the radius (R2) of the circular arc-shaped outer peripheral surface of the suction side bush (27B) have the same dimension), and the suction side bush (27B) is formed such that it has a greater width than that of the discharge side bush (27A). The reason for this is explained as follows.

First, both the low pressure chamber (C1-Lp) of the outer cylinder chamber (C1) and the low pressure chamber (C2-Lp) of the inner cylinder chamber (C2) are spaces around the periphery of the suction side bush (27B) and are constantly at low pressure, and there is hardly created any pressure difference between both the spaces (C1-Lp, C2-Lp). On the other hand, the high pressure chamber (C1-Hp) of the outer cylinder chamber (C1) and the high pressure chamber (C2-Hp) of the inner cylinder chamber (C2) are spaces around the periphery of the discharge side bush (27A) and undergo pressure variations of from low to high level, and there is created a considerable difference in pressure between the spaces (C1-Hp, C2-Hp). Consequently, load acts on the circular arc-shaped contact surface between the high pressure side bush (27A) and the annular piston (22) because the high pressure side bush (27A) is pressurized from above or below in the drawing. If the high pressure side bush (27A) is large, this increases the load which is applied to the contact surface; however, in this example, the width of the high pressure side bush (27A) is small, thereby reducing the load which is applied to the contact surface.

Alternatively, the swinging bushes (27A, 27B) may be constructed as shown in FIG. 15. In the example of FIG. 15, although the center of the circular arc-shaped outer peripheral surface of each of the swinging bushes (27A, 27B) agrees with the center of the blade (23), the radius (R1) of the circular arc-shaped outer peripheral surface of the discharge side bush (27A) and the radius (R2) of the circular arc-shaped outer peripheral surface of the suction side bush (27B) differ from each other. In other words, the width of the suction side bush (27B) is made greater than the width of the discharge side bush (27A) by making the radius (R2) of the circular arc-shaped outer peripheral surface of the suction side bush (27B) greater than the radius (R1) of the circular arc-shaped outer peripheral surface of the discharge side bush (27A). Also with this arrangement, the load acting on the contact surface between the high pressure side bush (27A) and the annular piston (22) can be restrained for the same reason as descried above.

In addition, in each of the foregoing embodiments, the blade (23) is disposed such that it is positioned on the radial line of the cylinder chamber (C1, C2). Alternatively, the blade (23) may be disposed such that it is inclined against the radial line of the cylinder chamber (C1, C2).

Furthermore, in each of the foregoing embodiments, the description has been made with respect to a compressor as an embodiment of the fluid machine of the present invention. However, the present invention may be applied to an expander in which gas, such as high pressure refrigerant, is introduced into a cylinder chamber and force for driving a rotational shaft is generated by expansion of the introduced gas, and to a pump.

In addition, the driving mechanism (30) is not necessarily housed within the casing (10). Alternatively, the compression mechanism (eccentric rotary piston mechanism) (20) may be driven from outside the casing (10).

It should be noted, however, that the aforesaid embodiments are essentially preferable examples which are not meant to limit the present invention, its application, or its range of application.

As has been described above, the present invention is useful for a rotary fluid machine having an eccentric rotary piston mechanism in which: a cylinder (21) has an annular cylinder chamber (C1, C2); an annular piston (22) is disposed in the annular cylinder chamber (C1, C2), the annular piston (22) dividing the cylinder chamber (C1, C2) into an outer cylinder chamber (C1) and an inner cylinder chamber (C2); the cylinder (21) and the annular piston (22) are so configured as to relatively execute eccentric rotary motion; and each of the outer and inner cylinder chambers (C1, C2) is divided by a blade (23) into a first chamber (C1-Hp, C2-Hp) and a second chambers (C1-Lp, C2-Lp).

What is claimed is:

1. A rotary fluid machine comprising:

an eccentric rotary piston mechanism including a cylinder having an annular cylinder chamber, an annular piston housed in an eccentric fashion relative to the cylinder in the cylinder chamber and dividing the cylinder chamber into an outer cylinder chamber and an inner cylinder chamber, and a blade disposed in the cylinder chamber and dividing each of the outer and inner cylinder chambers into a first chamber and a second chamber, the cylinder and the annular piston relatively executing eccentric rotary motion;

a driving mechanism for driving the eccentric rotary piston mechanism;

a casing configured to house the eccentric rotary piston mechanism; and a coupling member by which the annular piston and the blade are mutually movably coupled together, the cylinder being provided with the blade, the coupling member having a first sliding surface against the annular piston and a second sliding surface against the blade, and the outer cylinder chamber being formed on an outside of the annular piston and the inner cylinder chamber being formed on an inside of the annular piston differ from each other in suction shutoff angle, a suction shutoff angle of the outer cylinder chamber being greater than a suction shutoff angle of the inner cylinder chamber.

2. A rotary fluid machine comprising:

an eccentric rotary piston mechanism including a cylinder having an annular cylinder chamber, an annular piston housed in an eccentric fashion relative to the cylinder in the cylinder chamber and dividing the cylinder chamber into an outer cylinder chamber and an inner cylinder chamber, and a blade disposed in the cylinder chamber and dividing each of the outer and inner cylinder chambers into a first chamber and a second chamber, the cylinder and the annular piston relatively executing eccentric rotary motion;

a driving mechanism for driving the eccentric rotary piston mechanism;

a casing configured to house the eccentric rotary piston mechanism; and a coupling member by which the annular piston and the blade are mutually movably coupled together, the cylinder being provided with the blade, the coupling member having a first sliding surface against the annular piston and a second sliding surface against the blade, the annular piston being formed into a C-shape with a split, the blade being configured to be inserted through the split of the annular piston so that the blade extends from an inner peripheral wall surface to an outer peripheral wall surface of the annular cylinder chamber, the coupling member being formed by a swinging bushing having a blade groove that advanceably and withdrawably holds the blade and a circular arc-shaped outer peripheral surface that is swingably held in the split by the annular piston, the outer cylinder chamber being formed on an outside of the annular piston and the inner cylinder chamber being formed on an inside of the annular piston differ from each other in suction shutoff angle, and a suction shutoff angle of the outer cylinder chamber being greater than a suction shutoff angle of the inner cylinder chamber.

* * * * *